US011970300B2

(12) United States Patent
White et al.

(10) Patent No.: US 11,970,300 B2
(45) **Date of Patent: *Apr. 30, 2024**

(54) APPARATUSES, SYSTEMS, AND METHODS FOR THE AUTOMATED DISPENSING OF AND PACKAGING OF ARTICLES

(71) Applicant: Omnicell, Inc., Cranberry, PA (US)

(72) Inventors: David J. White, Murrysville, PA (US); Patrick J. Braun, Pittsburgh, PA (US)

(73) Assignee: OMNICELL, INC., Mountain View, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/455,356

(22) Filed: Nov. 17, 2021

(65) Prior Publication Data

US 2022/0073220 A1 Mar. 10, 2022

Related U.S. Application Data

(63) Continuation of application No. 16/456,636, filed on Jun. 28, 2019, now Pat. No. 11,214,391.

(51) Int. Cl.
*B65B 5/06* (2006.01)
*B65B 7/02* (2006.01)
(Continued)

(52) U.S. Cl.
CPC ..... *B65B 5/067* (2013.01); *B65B 7/02* (2013.01); *B65B 39/12* (2013.01); *B65B 43/123* (2013.01);
(Continued)

(58) Field of Classification Search
CPC ..... B65B 5/067; B65B 7/02; B65B 39/12; B65B 43/123; B65B 43/36
See application file for complete search history.

(56) References Cited

U.S. PATENT DOCUMENTS 862,231 A * 8/1907 Bates ..... B65B 1/18 141/237
2,805,898 A 9/1957 Willis, Jr.
(Continued)

FOREIGN PATENT DOCUMENTS

DE 2139470 A1 4/1972
EP 0447012 A1 9/1991
(Continued)

OTHER PUBLICATIONS

1st Office Action for Korean Application No. 10-2021-7000647 dated May 25, 2022 (13 pages).
(Continued)

*Primary Examiner* — Joshua G Kotis
(74) *Attorney, Agent, or Firm* — ALSTON & BIRD LLP

(57) ABSTRACT

Provided herein is a system for automated dispensing and packaging of articles. Systems may include: a controller configured to receive an indication of an order to be packaged, where the order includes one or more articles; a packaging station; a web of bags, where the web of bags is fed to the packaging station; a pneumatic table configurable to support a bag disposed at the packaging station; an opening mechanism including a pneumatic nozzle to open the bag disposed at the packaging station; a loading bin configured to be inserted into the open bag and deposit the one or more articles; and a closure apparatus to seal the bag disposed at the packaging station after receiving the one or more articles.

16 Claims, 15 Drawing Sheets

(51) Int. Cl.

| | |
|---|---|
| ***B65B 39/12*** | (2006.01) |
| ***B65B 43/12*** | (2006.01) |
| ***B65B 43/36*** | (2006.01) |
| ***B65B 43/54*** | (2006.01) |
| ***B65B 51/10*** | (2006.01) |
| ***B65B 57/00*** | (2006.01) |
| ***B65B 61/02*** | (2006.01) |

(52) U.S. Cl.
CPC ..... *B65B 43/36* (2013.01); *B65B 43/54* (2013.01); *B65B 51/10* (2013.01); *B65B 57/00* (2013.01); *B65B 61/025* (2013.01)

(56) References Cited

U.S. PATENT DOCUMENTS

| | | | | | |
|---|---|---|---|---|---|
| 2,848,820 | A * | 8/1958 | Wallin | B65H 20/14 | 65/25.2 |
| 3,156,273 | A * | 11/1964 | Piazze | B65B 43/36 | 141/10 |
| 3,197,936 | A * | 8/1965 | Messmer | B65B 43/36 | 53/492 |
| 3,254,828 | A * | 6/1966 | Lerner | B65B 43/267 | 206/820 |
| 3,477,558 | A * | 11/1969 | Fleischauer | B65G 49/065 | 198/689.1 |
| 3,552,090 | A | 1/1971 | Roberts et al. | | |
| 3,624,782 | A | 11/1971 | McPeek | | |
| 3,759,579 | A * | 9/1973 | Johnston | B65G 51/03 | 406/88 |
| 3,761,134 | A | 9/1973 | Hurd | | |
| 3,765,324 | A * | 10/1973 | O'Neill | B30B 9/3057 | 100/220 |
| 3,773,391 | A * | 11/1973 | Crandall | B65G 51/03 | 406/88 |
| 3,889,449 | A * | 6/1975 | Membrino | B65B 43/36 | 53/385.1 |
| 3,897,676 | A * | 8/1975 | Membrino | B65B 43/36 | 53/385.1 |
| 4,202,153 | A | 5/1980 | Lerner | | |
| 4,203,269 | A | 5/1980 | Petersen | | |
| 4,393,640 | A | 7/1983 | Cole | | |
| 5,706,931 | A * | 1/1998 | Gori | B65G 59/026 | 198/493 |
| 6,330,351 | B1 | 12/2001 | Yasunaga | | |
| 6,516,587 | B1 | 2/2003 | Chikatani | | |
| 6,519,916 | B1 * | 2/2003 | Brown | B65G 51/02 | 53/403 |
| 6,601,707 | B2 | 8/2003 | DeSmedt | | |
| 6,996,955 | B2 * | 2/2006 | White, Jr. | B65B 67/00 | 83/402 |
| 7,513,716 | B2 | 4/2009 | Hayashi | | |
| 7,654,064 | B2 | 2/2010 | Riccardi | | |
| 7,748,199 | B2 | 7/2010 | Sankaran | | |
| 8,464,901 | B2 * | 6/2013 | Karwacki, Jr. | B65H 3/08 | 221/278 |
| 10,586,418 | B2 | 3/2020 | Greyshock | | |
| 11,214,391 | B2 * | 1/2022 | White | B65B 43/267 | |
| 2004/0255556 | A1 | 12/2004 | Boal | | |
| 2007/0175235 | A1 * | 8/2007 | Metzger | B65B 61/28 | 62/344 |
| 2007/0240386 | A1 * | 10/2007 | Zeedyk | B65B 51/146 | 53/238 |
| 2013/0061556 | A1 | 3/2013 | Hatsuno | | |
| 2014/0108028 | A1 | 4/2014 | Braun | | |
| 2017/0203867 | A1 | 7/2017 | Shook | | |
| 2019/0102965 | A1 | 4/2019 | Greyshock | | |
| 2021/0188567 | A1 * | 6/2021 | Joely | G05D 7/0688 | |

FOREIGN PATENT DOCUMENTS

| | | | |
|---|---|---|---|
| FR | 2057265 | A5 | 5/1971 |
| JP | 61-19436 | | 2/1986 |
| JP | 62-132909 | | 8/1987 |
| WO | WO-2019/067174 | A1 | 4/2019 |

OTHER PUBLICATIONS

Office Action for Japanese Patent Appln No. 2021-510165 dated Mar. 22, 2022 with English translation (4 pages).
International Search Report and Written Opinion for PCT/US2020/038357 dated Sep. 24, 2020 (13 pages).
Notice of Allowance for Korean Application No. 10-2021-7000647 dated Dec. 28, 2022 w/English translation (3 pages).
Decision to Grant for Japanese Patent Application No. 2021-510165 dated Oct. 12, 2022.
Office Action for Canadian Application No. 3,107,490 dated Mar. 23, 2022 (6 pages).
Office Action for Japanese Patent Application No. 2021-510165 dated Jul. 4, 2022 with English Translation (4 pages).
1st Office Action for European Application No. 20736552.9 (EPO) dated Oct. 19, 2021 (5 pages).
Notice of Allowance for Canadian Application No. 3,107,490 dated Feb. 1, 2023 w/English translation (1 page).
Office Action for Japanese Patent Application No. 2022-181716 dated Oct. 26, 2023 w/English translation (15 pages).

* cited by examiner

APPARATUSES, SYSTEMS, AND METHODS FOR THE AUTOMATED DISPENSING OF AND PACKAGING OF ARTICLES

CROSS-REFERENCE TO RELATED APPLICATIONS

This application is a continuation of U.S. patent application Ser. No. 16/456,636, filed on Jun. 28, 2019, the contents of which are hereby incorporated by reference in their entirety.

TECHNOLOGICAL FIELD

Embodiments of the present invention relate generally to automated dispensing and packaging of articles, and in particular, to automated dispensing of articles of various configurations, sizes, and combinations into packaging for distribution. Embodiments may include full or partial automation of the process and may include mechanisms for improving the efficiency and accuracy of medication dispensing.

BACKGROUND

The dispensing of goods is a common practice that can often be time consuming and prone to error, particularly when performed manually. The automation of dispensing can improve both efficiency and accuracy of the dispensing operation; however, different types of articles necessarily require different types of dispensing. Further, automated dispensing can be costly, and if the dispensing operations are not frequent enough, or there is a low-risk associated with errors, the cost of automation may not be justified.

One particular field in which dispensing accuracy is critical is that of medication dispensing. Medication dispensing, such as in healthcare facilities, can be a complex and time consuming process. With medication orders changing, and with the significant potential ramifications of dispensing the incorrect medication to a patient, the process of delivering medication from the central pharmacy to the patient can be a high-risk process in a healthcare setting.

Healthcare facilities generally dispense medications from a central pharmacy to patients with a number of verification steps performed along the way to ensure that the medication is of the correct type and dose and that the appropriate patient receives the medication. The verification steps may add complexity and time to the process, thereby reducing the efficiency. Therefore it may be desirable to implement apparatuses, systems, and methods which may automate some or all of the process and which may increase the efficiency with which medications are delivered to a patient.

SUMMARY

Embodiments of the present invention may provide an automated packaging system to facilitate the automated dispensing and packaging of articles. Embodiments of the system may include: a controller configured to receive an indication of an order to be packaged, where the order includes one or more articles; a packaging station; a web of bags, where the web of bags is fed to the packaging station; a pneumatic table configurable to support a bag disposed at the packaging station; an opening mechanism including a pneumatic nozzle to open the bag disposed at the packaging station; a loading bin configured to be inserted into the open bag and deposit the one or more articles; and a closure apparatus to seal the bag disposed at the packaging station after receiving the one or more articles. The loading bin may include a loading bin having a front panel and a bottom panel, where in response to insertion of the loading bin into the open bag, the front panel may be raised and the bottom panel withdrawn from the open bag, where in response to the front panel being raised and the bottom panel withdrawn, the loading bin is withdrawn from the open bag leaving the one or more articles within the bag.

According to some embodiments, the system may include a printhead configured to print identifying indicia to the web of bags as they are fed into the packaging station and an indicia reader configured to read the identifying indicia printed to the web of bags. The opening mechanism of some embodiments may include one or more fingers configured to be inserted into an opening of the bag disposed at the packaging station at least partially opened by the pneumatic nozzle and to hold the bag in a fully open position during a filling operation of the bag.

The pneumatic table of some embodiments may include at least two positions including a raised position and a lowered position, where the position of the pneumatic table is established by the controller in response to operating parameters defined, at least in part, by the one or more articles of the order. The pneumatic table may include at least two positions including a raised position and a lowered position, where the position of the pneumatic table may be established by the controller in response to operating parameters defined, at least in part, by the one or more articles of the order. The pneumatic table may include at least two different levels of air flow through the table, where the level of air flow through the table is established by the controller in response to the operating parameters defined, at least in part, by the one or more articles of the order.

Embodiments described herein may provide a method including: receiving an indication of an order, where the order includes one or more articles; identifying the one or more articles of the order; identifying operating parameters of the automated packaging system based, at least in part, on the identified one or more articles of the order; and operating the packaging system according to the identified operating parameters. Operating the packaging system according to the identified parameters may include: printing indicia to a first bag of a web of bags; feeding the first bag of the web of bags to a packaging station of the packaging system; opening the first bag of the web of bags using a pneumatic nozzle; inserting a loading bin containing the one or more articles into the first bag through the opening; and depositing the one or more articles into the first bag.

According to some embodiments, operating the packaging system according to the identified parameters may further include: raising a pneumatic table in response to an identified operating parameter; and supplying the pneumatic table with a predetermined level of air flow in response to another identified operating parameter. Operating the packaging system according to identified parameters may include providing a stream of air to push the one or more articles into the first bag through the opening after removal of the loading bin from the first bag in response to an identified operating parameter. Operating the packaging system according to the identified parameters may further include controlling the loading bin to raise an end panel of the loading bin and withdrawing a bottom panel of the loading bin in response to insertion of the loading bin into the first bag through the opening.

According to some embodiments, operating the packaging system according to the identified operating parameters may include withdrawing the loading bin from the first bag in response to the end panel being raised and the bottom panel removed. Operating the packaging system according to the identified operating parameters may include operating a closure mechanism to seal the opening of the first bag in response to the loading bin having been withdrawn from the first bag.

Embodiments provided herein may include a packaging system, wherein the packaging system includes: a packaging station configured to receive therein a web of bags; a nozzle directed toward an opening of a bag of the web of bags in response to the bag being disposed in the packaging station, where the nozzle directs air to the opening of the bag to inflate and open the bag; a pneumatic table to support the bag at the packaging station; a loading bin operable to be inserted into the open bag at the packaging station, deposit one or more articles from the loading bin into the open bag, and to be removed from the open bag; and a closure apparatus configured to seal the opening of the bag in response to the bag being loaded with one or more articles. Embodiments may include one or more fingers to hold open the bag at the packaging station in response to the bag being opened by the nozzle. The pneumatic support table may be configurable in at least two positions relative to the packaging station.

According to some embodiments, the pneumatic support table may be configured to direct air flow through the table to reduce friction between the bag at the packaging station and the pneumatic table. The closure apparatus may include a closure bar configured to close the opening of the bag at the packaging station against a heating element, where the heating element thermally seals the opening of the bag. The loading bin may include a front panel and a bottom panel, where in response to the loading bin being inserted into the open bag at the packaging station, the bottom panel may be withdrawn from the open bag and the front panel raised. The nozzle may be configured to direct a flow of air to the deposited one or more articles in response to the loading bin being withdrawn from the open bag to drive the deposited one or more articles into the bag, clear of the opening of the bag. The nozzle may be configured to, in an instance in which the bag at the packaging station cannot be opened, direct a stream of air to the unopened bag to clear the bag from the packaging station.

DESCRIPTION OF THE DRAWINGS

Reference now will be made to the accompanying drawings, which are not necessarily drawn to scale, and wherein.

DETAILED DESCRIPTION

Figure 1:
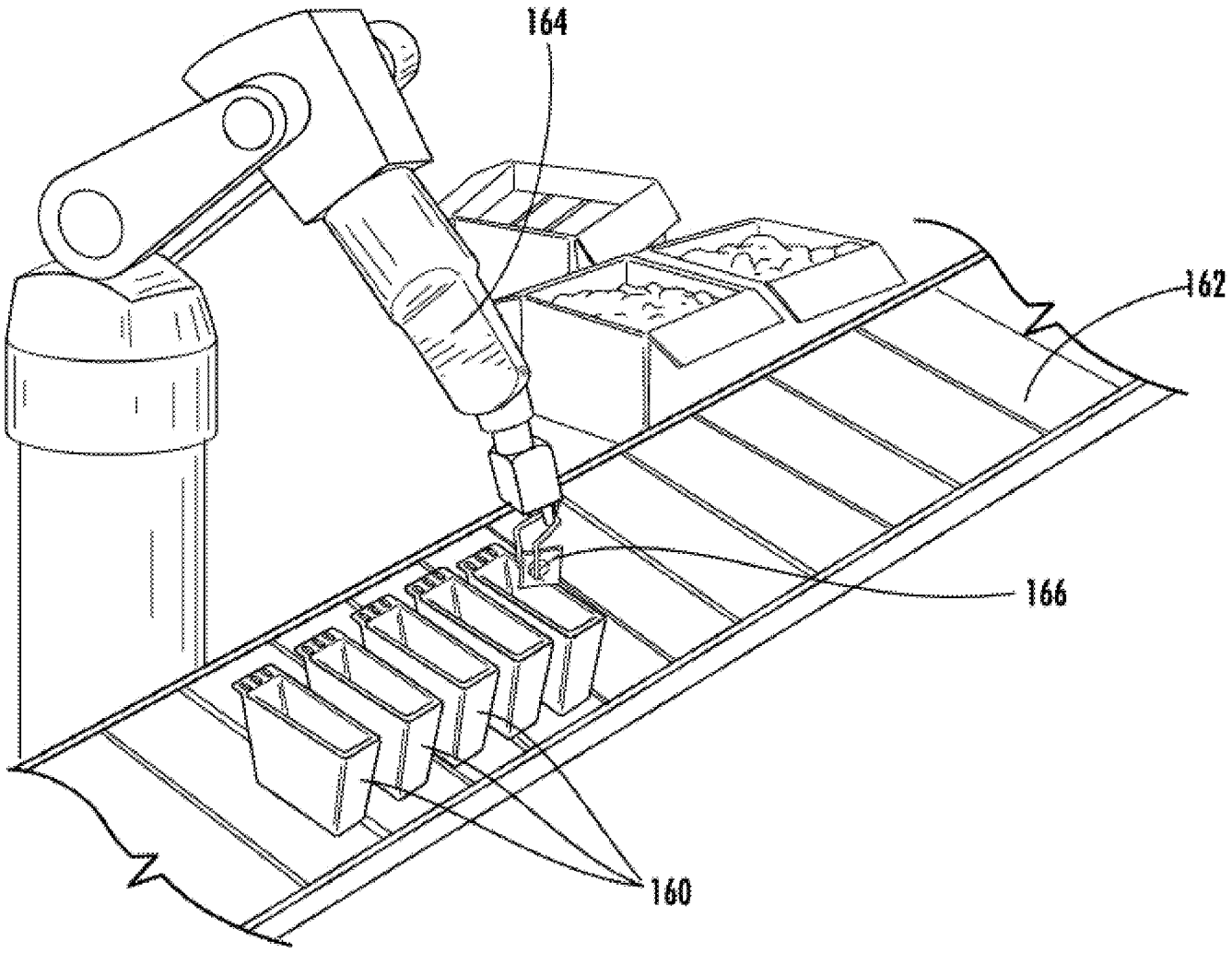
FIG. 1 illustrates an automated dispensing system according to an example embodiment of the present disclosure.

Embodiments of the present invention may provide various apparatuses, systems, and methods for improving the efficiency of medication distribution within a healthcare facility. Some embodiments and components of the present invention will now be described more fully hereinafter with reference to the accompanying drawings, in which some, but not all embodiments of the invention are shown. Indeed, various embodiments of the invention may be embodied in many different forms and should not be construed as limited to the embodiments set forth herein; rather, these embodiments are provided so that this disclosure will satisfy applicable legal requirements.

Example embodiments of the present invention may provide a method, apparatus, and computer program product which may facilitate the automated dispensing and packaging of articles, such as the dispensing and packaging of medications within a healthcare facility. Embodiments may improve the efficiency and accuracy of dispensing and packaging articles, incorporating mechanisms that may solve issues identified by the applicant as substantial hurdles in automating the dispensing of articles, particularly when those articles are of differing sizes, shapes, and weights, and placing them into packaging based on orders.

While embodiments of the present invention may be described primarily with respect to the dispensing and packaging of medications and medical supplies in healthcare facilities, such as hospitals and long-term care facilities, for example, embodiments of the inventions described herein may be implemented in a variety of types of facilities, not limited to those explicitly described herein. For example, embodiments may be implemented in distribution warehouse environments in which articles may be dispensed for fulfilling orders and packaged for dispensing or shipping. While certain aspects of embodiments described herein may be specific to medication dispensing and the associated accuracy required therewith, similar implementations may omit certain features or include other features as would be apparent to one of ordinary skill in the art.

Healthcare facilities may include a central pharmacy in which medications are stored and dispensed to areas throughout the healthcare facility. Some healthcare facilities may rely on a supplier, distribution center, or remote central pharmacy which stores medications and supplies at a remote location and delivers the medications and supplies on an as needed basis. In such an embodiment, the medications from the supplier, distribution center, or remote central pharmacy may be received by a healthcare facility at a receiving area. While embodiments of the present invention may be described as dispensing and packaging medication from a central pharmacy, embodiments in which central pharmacies are located remotely or embodiments using distribution centers may implement embodiments of the inventions from the area in which medications and supplies are received from the central pharmacy or distribution center. The indication of medications needed may be provided to the central pharmacy or distribution center with sufficient lead time such that the healthcare facility may receive the medications in advance of when they are needed.

While automated dispensing and packaging systems of example embodiments described herein may be used to dispense and package various types of articles, the primary embodiment described herein is particularly well suited for dispensing and packaging medications and medical supplies. However, it is appreciated that other articles may similarly benefit from the various configurations of the disclosed automated dispensing and packaging systems.

As noted above, an automated dispensing and packaging system according to example embodiments may be implemented in, for example, a central pharmacy of a healthcare facility. Medications dispensed from a central pharmacy may be of a variety of form factors from individual pills or capsules to intravenous bags of a liter or more capacity. Other form factors may include syringes, carpujects, vials, multi-dose medication containers, etc. Supplies, such as intravenous medication tubing, empty syringes, etc. may be dispensed from a separate medical supply distribution center within a healthcare facility, or in some cases, the central pharmacy and medical supply distribution operations may be combined. Both the supplies and the medications may come in a variety of sizes and shapes and may not easily and efficiently dispensed from a conventional automated dispensing apparatus. Further, the substantial variation in sizes, shapes, and weights may render packaging very difficult, particularly automated packaging. While a unit dose medication contained in a blister package may be easily handled due to the small size and a substantially planar surface available for grasping, intravenous bags may be relatively cumbersome with non-rigid packaging and a relatively high weight. Further, products may be relatively fragile, such as a carpuject, ampoule, or vial, such that appropriate care must be taken in dispensing and packaging of these products.

While certain medications are configured to be dispensed in vials where a syringe is a required supply to accompany the vial, other medications may require a patient to consume food or a beverage other than water. In such cases, the food or beverage to accompany the medication may be treated as a supply, and such supplies may also be dispensed and packaged as other supplies may be dispensed as described herein.

According to some embodiments described herein, some articles may be packaged into overpacks or packaging that encases or holds the medication or supplies in a package form factor that is one or more of more uniform, more easily grasped, more easily stored, etc. Overpacks may provide a common packaging size, profile, shape, grasping feature, content protection, uniform identification, etc.

Orders for articles, including medications and medication supplies, may be received by an automated system for dispensing and packaging of the articles. Orders may include a plurality of articles which may be grouped according to a variety of factors. For example, articles may be grouped based on a recipient, such as a patient who has prescriptions for multiple medications, where all medications of the prescription order may be combined into a single package. Articles may be grouped based on a recipient and a time, such as all of the medications for a particular patient for a particular day or time of day. Optionally, articles may be grouped by destination, such as the medications needed for a patient room in a facility where there may be two or more patients in the room, and their medications are both included in a bag. Articles may be grouped according to a wide variety of commonalities that may improve logistics for dispensing and delivering of articles to a destination.

While orders may include a plurality of articles, orders may include only a single article. Embodiments described herein are capable of automated dispensing and packaging of a wide range of product sizes, weights, shapes, and quantities. The automated dispensing of example embodiments provided herein may use a variety of available techniques and methods such as robot pick and retrieval, as illustrated in FIGS. 1 and 2.

As illustrated in FIG. 1, empty bins 160 of various sizes may be configured to be transported along a conveyor 162 and be filled by a robot 164 or other form of automation. The robot 164 may retrieve an article identified in an order from a storage location, such as bulk storage location, and advance the article 166 to a bin or location on the conveyor 162. The conveyor 162 may advance the articles from the automated dispensing station of FIG. 1 to an automated packaging station described further below.

Figure 2:
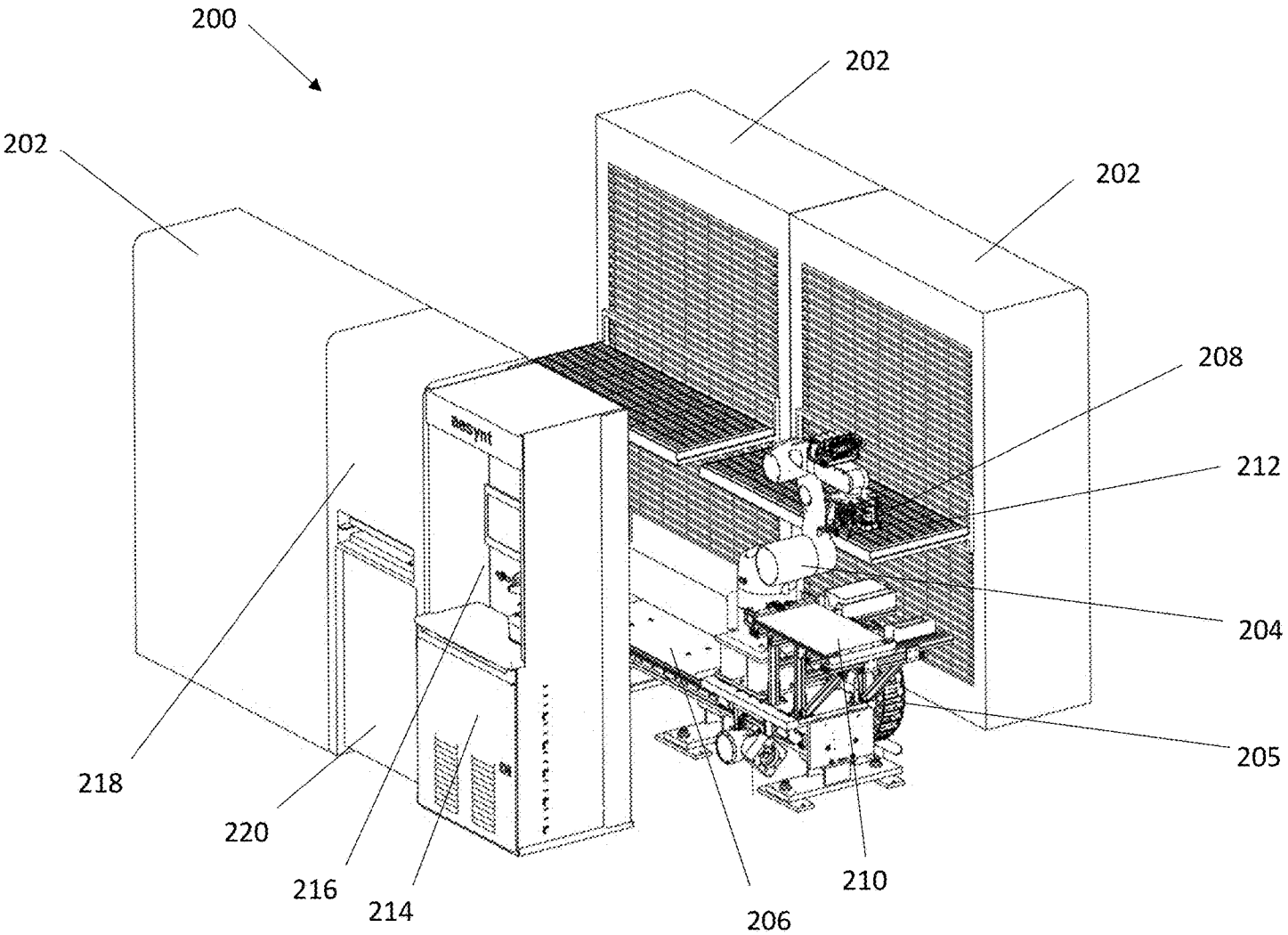
FIG. 2 illustrates another automated dispensing system according to an example embodiment of the present disclosure.

FIG. 2 illustrates another example embodiment of an automated dispensing device system 200 according to an example embodiment of the present disclosure which may be controlled by a controller as described further below with respect to FIG. 11. The illustrated embodiment includes a plurality of storage modules 202 arranged proximate a robot 204, which may be, for example, a six-axis robotic arm for retrieval and dispensing of articles as described further below. The robot 204 may be positioned on a track system 206 to allow the robot to move along the track providing greater access to the storage modules and allowing for expandability and modularity of the automated dispensing system. The robot 204 may include an end-of-arm tool 208 configured to attach to articles for retrieval, movement, and placement as necessary.

According to some embodiments, a work platform 210 may be provided to facilitate distribution of articles and the manipulation of articles as will be evident by the following disclosure. This work platform 210 may advantageously be coupled to the robot 204 and may traverse the track system 206 with the robot 204. The robot and work platform 210 may move along the track system in any conventional manner, such as with a pinion gear attached to the robot 204 base, with a rack gear extending along the track system. Optionally, the robot 204 may be belt-driven along the track system 206. Regardless of the motive mechanism of the robot along the track system, the position of the robot along the track system may be precisely monitored via embedded sensors or tags in the track system, displacement measurement of the robot 204, or any method of measuring a position along the track system accurately. The measurement of position along the track system 206 may facilitate accurate and repeatable movement of the robot 204 arm and positioning of the end-of-arm tool 208 to enhance accuracy of retrieval and movement of articles throughout the system 200. Electrical power, hydraulic power (if needed), pneumatic communication (e.g., vacuum or pressure), and hard-wired communications may be in communication with the robot 204 through an umbilical 205 which may bundle all necessary wiring, plumbing, etc. and may enable the robot 204 to traverse the track 206 while remaining in electrical and fluid communication with stationary equipment, such as a controller, hydraulic pump, pneumatic pump, and electrical power source, for example.

The storage modules 202 may be configured to store a plurality of articles, where each article is accessible to the end-of-arm tool 208 of the robot 204. While an arrangement of vertical shelves may be sufficient to store a plurality of articles, in order to increase the storage density, the available storage locations may extend horizontally to provide a substantial increase in storage capacity. To achieve this increased storage capacity, the storage modules may include a plurality of trays 212 which may be received within the storage modules 202 and may be configured to be moved between a storage position where the tray 202 is received within the storage module, and a retrieval position, in which the tray 212 is slid out from the storage module, accessible to the robot 204 and end-of-arm tool 208.

Figure 11:
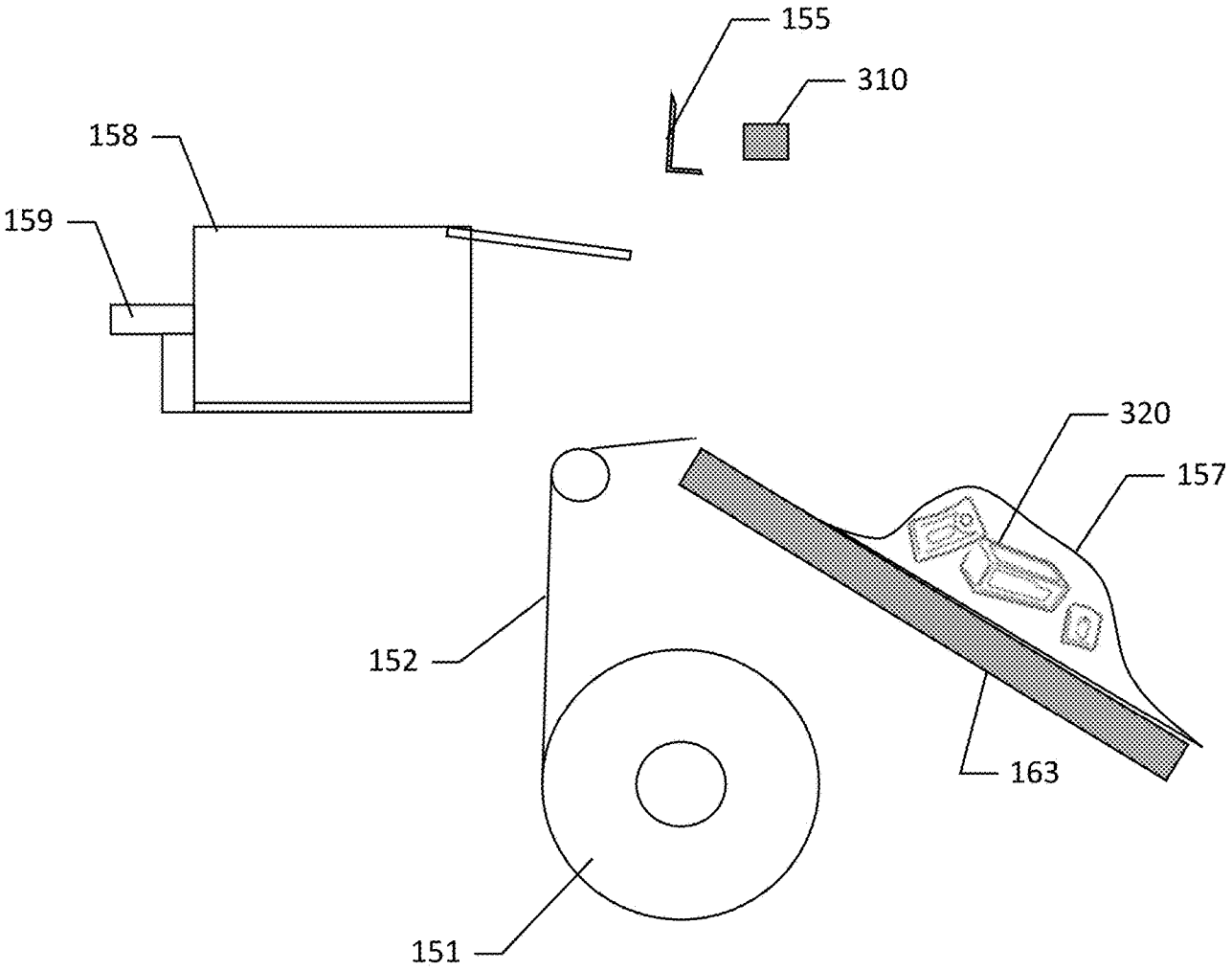
FIG. 11 illustrates the automated packaging system of FIG. 10 with the pneumatic table moved to a lowered position to eject the sealed package according to an example embodiment of the present disclosure.

The automated dispensing device system 200 of example embodiments may further include a user module 214, which may be embodied by the controller of FIG. 11, or separate therefrom. While an automated dispensing device system 200 of example embodiments may be capable of being fully controlled through a remote interface or remote order request/fulfillment apparatus, such as a remote workstation, computer, controller, etc., the illustrated embodiment includes a user module 214 integrated with the automated dispensing device system. The user module 214 may include a user interface 216. The user interface 216 may include a means for providing information to a user, such as a display (e.g., light emitting diode (LED) display, organic LED display, liquid crystal display (LCD), plasma display, etc.), and a means for a user to enter information. The means for entering information may include a touch screen display, a keyboard, pointing device (e.g., mouse), a scanning device (e.g., barcode scanner or radio frequency identification (RFID) scanner, etc.), or the like. The user module 214 may be used to request the dispensing of articles, to review a queue of articles to be dispensed, to review errors or correct issues, etc.

The automated dispensing device system 200 of example embodiments may dispense and package articles in an automated manner, and may do so to a delivery device. For example, the automated dispensing device system 200 may dispense articles from the trays 212 to, for example, a bin, which may in turn be used to advance articles to a packaging station or packaging module of the system 200. According to an example embodiment of an automated dispensing and packaging system of a healthcare facility, the system may receive a request to dispense one or more medications for an order. In response, the robot 204 may advance along the track system 206 to a position for accessing a tray containing one or more of the requested medications. The tray 212 may be advanced to the retrieval position, either through a mechanism of the storage module 202, or using the robot 204 to move the tray to the retrieval position. Once the tray is in the retrieval position, the robot end-of-arm tool 208 may be moved by the robot 204 to a position above the location in the tray where one of the requested medications is stored. The end-of-arm tool 208 may retrieve the medication stored therein, and move the medication to a dispensing location. The dispensing location may be, for example, a patient-specific or order-specific bin, which may be positioned on the work platform 210, or may be positioned at a dispensing area of a module of the system 200. Once the requested medications for the patient have each been retrieved and dispensed to the order-specific bin, the bin may be moved to packaging station.

The illustrated embodiment of FIG. 2 includes a cart module 218 and a cart 220. The cart 220 may be received within the cart module 218 from a position outside of the automated dispensing system 200, such that movement of the cart into and out of the cart module may not disrupt the operation of the robot 204 within the system. The cart may be accessible within the cart module 218 to the robot 204. The robot may move the patient-specific bin containing the requested medications to the cart 220 of the cart module 218 such that the patient specific bin is ready for transport to the patient with the cart 220. Optionally, the cart may include a plurality of storage locations therein and the robot 204 may dispense the medications requested for a patient to a storage location of the cart without requiring a separate patient-specific bin.

According to example embodiments described herein, the automated dispensing system 200 may dispense a plurality of articles, such as medications, to a packaging station, and subsequently to a transport device, such as a cart 220, without requiring manual intervention. This automated dispensing may be achieved through proper identification of articles as they are received in the automated dispensing system 200 and as they are retrieved within the system for dispensing.

Figure 3:
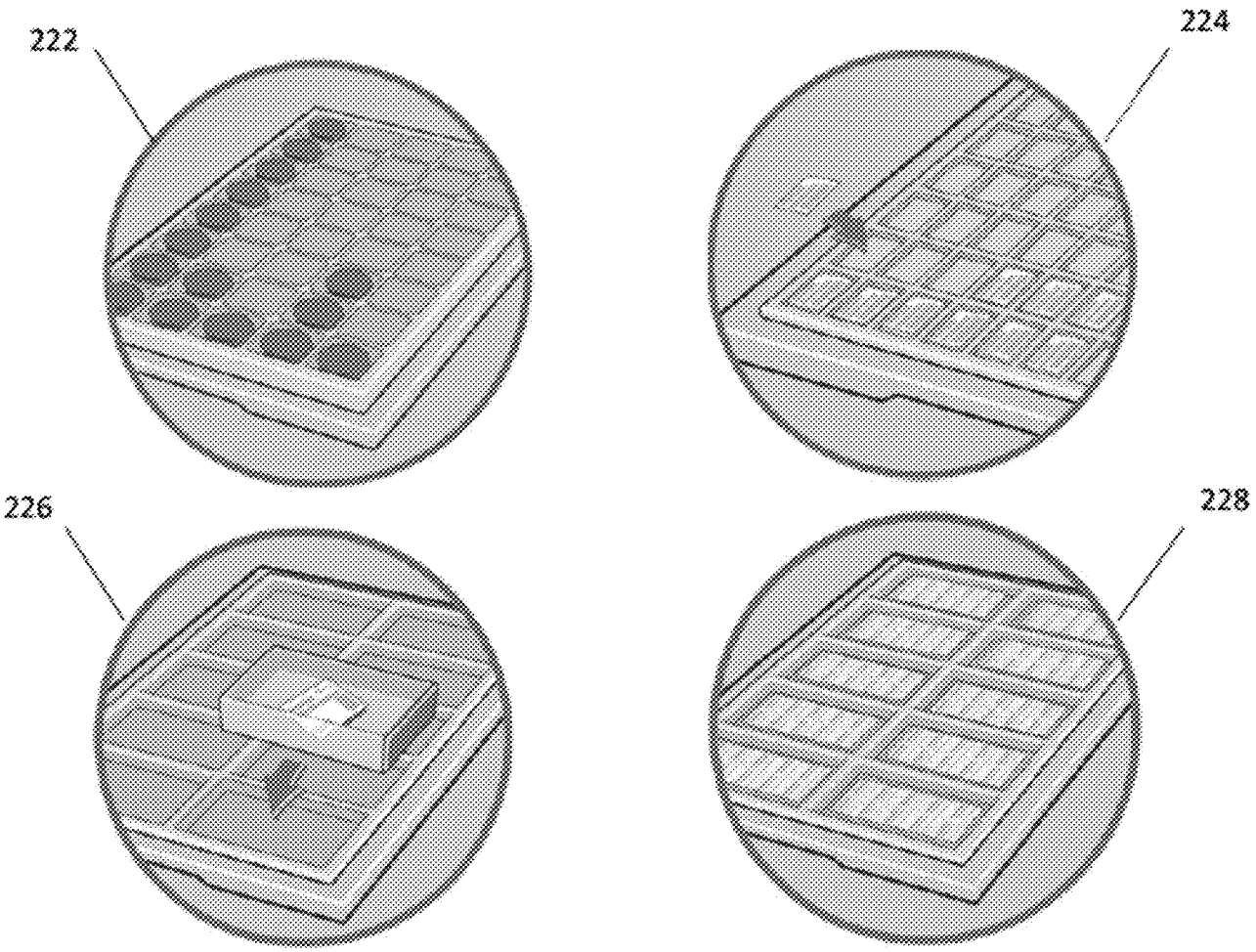
FIG. 3 depicts tray storage configurations of a plurality of example embodiments according to the present disclosure.

Each tray 212 within each storage module 202 may include a plurality of locations, where each location has a unique identification. The locations may be uniquely identified based on an identifier, such as a barcode or RFID tag at the location, or uniquely identified by coordinates (e.g., Cartesian coordinates) within the tray, for example. The trays may have various different configurations in order to accommodate different types of articles stored therein. FIG. 3 illustrates several potential configurations of trays according to example embodiments described herein. A tray may be configured to hold a plurality of cups, such as medication cups as shown at 222. A tray may be configured to hold a plurality of blisters, such as medication unit dose blister packages as shown at 224. A tray may be configured to hold a plurality of bins which may be of uniform or different sizes as shown at 226. These bins may be clear to facilitate identification of the articles contained therein as described further below. And trays may be configured to hold a plurality of cards, such as a card containing a plurality of individual unit dose blister packages as shown at 228. Trays may be configured in a variety of manners to hold any type of article requiring automated dispensing. Further, trays may be configured to hold various different form factors, including a combination of any of the tray configurations of FIG. 3 implemented in a single tray. The pockets of a tray may optionally be lined with a relatively higher friction material, particularly over smooth plastic tray pockets. This may enable example embodiments to maintain the position of an article loaded into a pocket, such as a medicine vial in a label-up position, and mitigate the effects of vibration and movement of the articles within the pocket to enable easier identification of the article in the pocket.

According to an example embodiment, each location of a tray may be uniquely identified such that a position of the location within the tray is known. The geometry of a tray and the locations therein may be stored within a memory, such as memory 232 of the controller illustrated in FIG. 4 and described further below. Each tray may be unique such that the memory 232 includes a unique layout and geometry together with location identifiers for each tray. In such an embodiment, each tray may include a unique identifier, such as a barcode, 2-dimensional barcode, an RFID tag, etc. Optionally, there may be a specific number of configurations of trays, and each configuration may have a unique identification. In such an embodiment, the identification of a tray may only provide the configuration information, while the location of the tray within the storage module may be stored within the memory of the controller 232 to facilitate retrieval of articles from the tray.

The trays 212 of example embodiments may be maintained within or associated with a particular storage module, such that the trays are replenished for dispensing of articles therefrom. However, according to some embodiments, the trays may be removable from the storage modules and replenishment may occur through replacement of trays within a storage module. In such a case where trays are removable from a storage module, an identification of a tray 212 may be read by a device, such as a scanning device, upon receipt into a storage module such that the controller can associate a specific tray with a specific location within the automated storage device.

As articles are dispensed from automated dispensing systems as described herein, replenishment of articles is required to maintain an inventory of articles for dispensing. The replenishment is an operation that may occur in downtime between dispensing operations, which may occur overnight in a healthcare facility where fewer medications are being dispensed, for example. Various methods for replenishment may be used to replenish the automated dispensing systems described herein, and replenishment in a fast and efficient manner may be important in implementations in which there is little downtime over which replenishment may occur.

The automated dispensing system 200 of example embodiments may also provide automated replenishment using the robot 204 and end-of-arm tool 208 as described herein. Replenishment may occur through replacement of entire trays 212, or portions thereof. For example, a replenishment cart may be received within cart module 218, where the replenishment cart includes a plurality of trays stored therein. These trays may include a plurality of storage locations as described above with respect to FIG. 3. The trays may be removable from the cart, such that a tray may be retrieved by the robot 204. The trays of the replenishment cart may be of the same size as the trays 212 of the storage module 202, and may be interchangeable with the trays of the storage module. In such an embodiment, replenishment may occur through the swapping of trays within the storage module with a replacement tray from the replenishment cart. However, according to some embodiments, the replenishment cart may not be of sufficient size to hold trays of the same size as those in the storage modules.

The trays of the storage modules may be relatively large, such that replenishment may occur on only a portion of the trays of the storage modules. In such an embodiment, the trays 212 of the storage modules 202 may include inserts, wherein the inserts include a plurality of locations, and each tray may include several inserts. In such an embodiment, inserts of the trays may be swapped during replenishment. For example, a tray 212 of the storage module may be configured to hold three inserts. An insert that is scheduled for replenishment (because the insert is empty, mostly empty, or contains articles that are now or will soon expire, etc.) may be removed from a tray 212 of the storage module 202 by the robot 204 using the end-of-arm tool 208. The replenishment cart received at the cart module 218 may include an insert to replace the removed insert. The robot 204 may retrieve the replenishing insert and place the replenishing insert into the tray 212. In such an embodiment, each insert may be individually identified, with locations of the inserts known and the contents thereof stored in a database, such as in memory 232 of the controller. Such inserts may promote the bulk replenishment of articles.

According to some embodiments, replenishment of articles may occur on a unit-by-unit basis. A replenishment cart may be received at the cart module 218, and may include a tray of articles for replenishment of the system 200. The tray may be removed from the replenishment cart, and placed into a location within the automated dispensing system 200 for access by the robot 204 and the end-of-arm tool 208, such as on work platform 210. The robot 204, using the end-of-arm tool 208 and advancing along the track system 206, may retrieve articles from the replenishment tray and place them into locations of the trays 212 of the storage unit. As this is done, a location and identification of the article may be stored by the controller, such as in memory 232.

According to some embodiments, the robot 204 may also be configured to, at the instruction of the controller, to move articles between different storage locations within one or more trays 212 of the storage modules 202. This may be performed to consolidate articles, or to place articles into strategic positions based on other articles that are likely to be retrieved with those articles. For example, if a first medication often causes a side effect that is treated with a second medication, the first and second medications may be placed proximate one another within a tray 212 of a storage module 202 as it is likely that both medications will require retrieval at the same time. Automated storage systems of example embodiments may also have trays or zones for which retrieval of articles is more efficient. For example, a tray that is at a height similar to that as the middle of the robot 204 height may be more efficiently accessed than a tray that is at the top or bottom of the robot's travel. High-volume articles, or articles that are frequently used, may be positioned in these more efficiently accessed areas to promote faster throughput of the automated dispensing system. The high volume articles may change seasonally (e.g. allergy medications) such that repositioning of medications may be performed by the robot 204 by instruction from the controller to optimize the organization of articles in the storage modules. Periodically, the robot 204, at the instruction of the controller, may de-fragment or defrag the stored articles by consolidating articles into a more condensed area of storage. Sparsely distributed articles may be brought together to promote efficient retrieval and dispensing of articles.

The robot 204 may include a scanner, such as a barcode scanner, RFID tag scanner/reader, etc., to read the identification of articles as they are retrieved and/or placed into storage locations. Further, this scanner may read the identification of trays 212, tray inserts, and/or locations within the trays or inserts. The scanner may be used to identify articles that are being dispensed or replenished in order to ensure accuracy and that the article that is stored in a particular location of the storage module is consistent with the article that is anticipated.

According to some embodiments, the scanner may be an image capture device, to capture images of a barcode or identifier and use the image, through barcode analysis or optical character recognition, to deduce the identity of the scanned image. In such an embodiment, the robot 204 may use the image capture device as a vision guidance system to facilitate learning locations within trays for articles. The image capture device may enable the robot to determine a centroid of an article in order to best grip the article to retrieve it. Further, the image capture device may enable the robot 204, through use of the controller, to determine an orientation of an article within a tray such that the end-of-arm tool can be properly positioned to retrieve the article based on the determined orientation.

Figure 4:
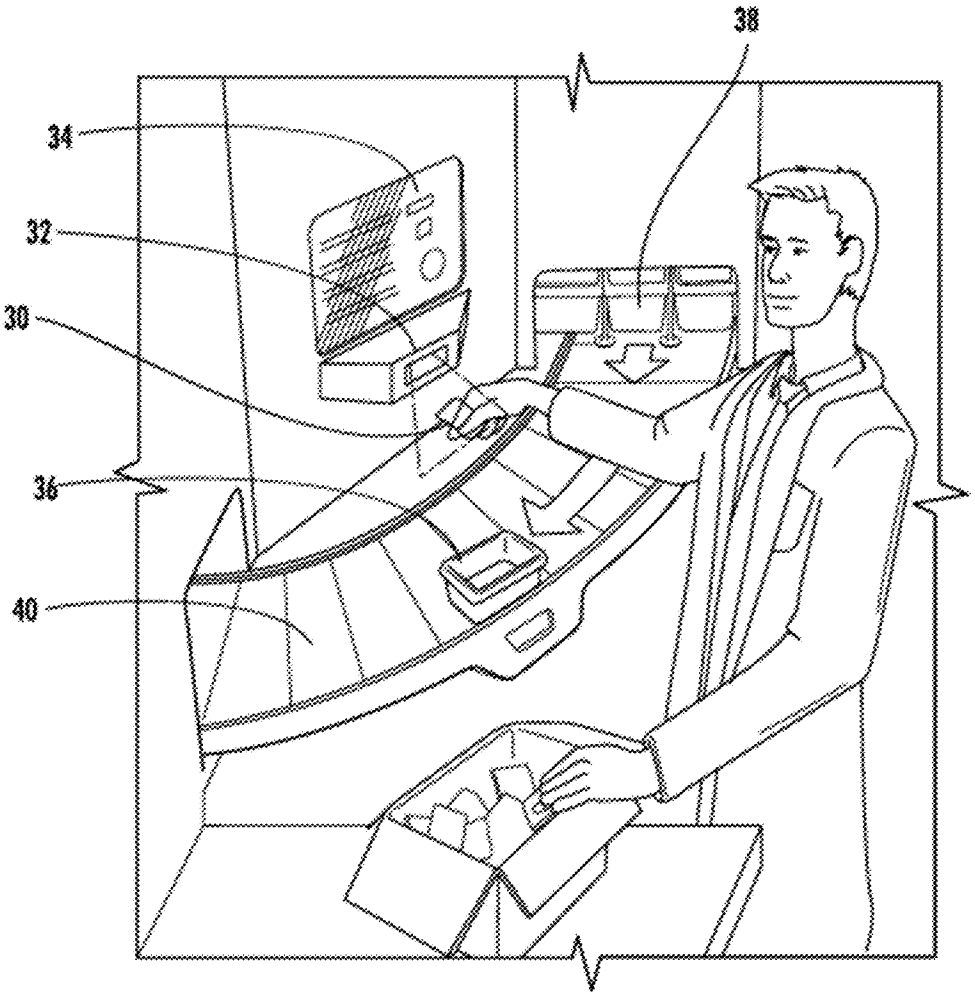
FIG. 4 illustrates a semi-automated dispensing system according to example embodiments of the present disclosure.

While an automated dispensing apparatus is described above with respect to FIGS. 1 and 2, embodiments of a packaging station as described herein may not require automated dispensing, and may be used in conjunction with manual dispensing or semi-manual dispensing. FIG. 4 illustrates an example embodiment of semi-automated dispensing where a user manually picks articles for dispensing into a container 36 that is advanced along conveyor 40. As shown, a user may retrieve an article and scan the article 30 with scanner 32 to read identifying indicia on the article to confirm the identification of the article 30. A user interface 34 may facilitate the process and may provide an indication of whether the scanned article is satisfactory. Bins 38 may be dispensed onto the conveyor by the semi-automated system of FIG. 4 while the user provides the function of the robot in the aforementioned automated embodiments.

As described further below, systems of example embodiments may include a packaging station where one or more articles are placed into a package, such as a bag and the bag becomes an overpack of the one or more articles of an order. In such an embodiment, medications may initially be retrieved and dispensed to a bin, where the bin is taken to a bagging or bag-loading device. The bags at the bagging station may be in a web of bags (e.g., on a roll or spool of bags) where the bags are either predefined lengths separated by perforations and sealed at one end, or the web of bags may be a continuous web of a tube of material, where the bagging station may seal the bags at one or both ends, and separate bags from one another as needed.

According to some embodiments, at a bagging station, a bag is printed to, with information such as the contents to be placed into the bag, a destination for the bag, a patient to whom the contents of the bag are prescribed, or the like. The bag may be printed with a unique, machine readable identifier for ease of machine recognition. The bag may be indexed to a position, scanned to ensure the indicia printed to the bag is appropriate, and then opened to receive medications.

Figure 5:
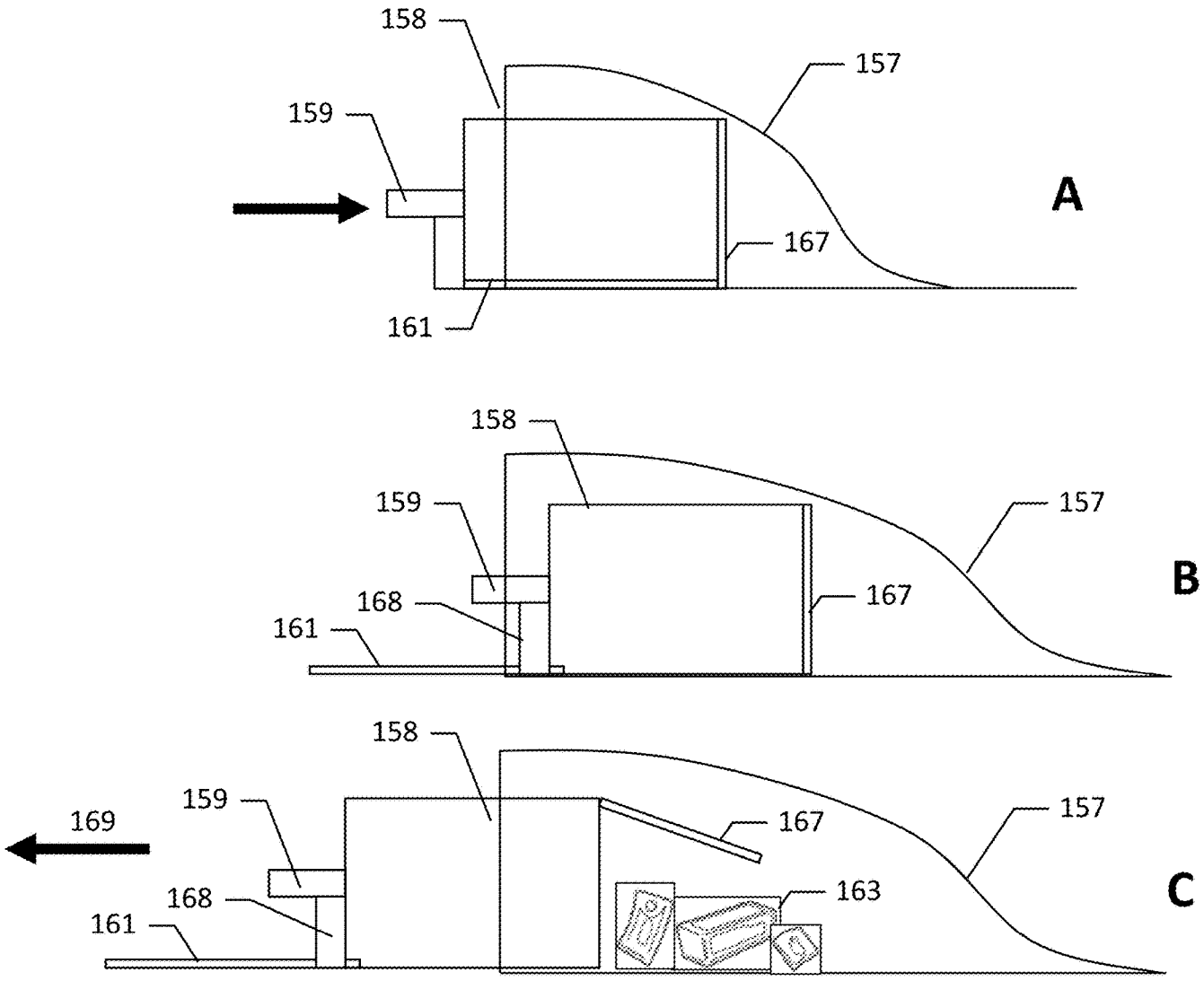
FIG. 5 illustrates a loading operation of an automated packaging system according to an example embodiment of the present disclosure.

FIG. 5 illustrates an example embodiment of a bag loading operation at a bagging station. As shown at A, loading bin 158 containing one or more medications is inserted into an open bag 157 at the bagging station. The loading bin 158 may be advanced, for example, by the robot 204 using an end-of-arm tool at 159. The loading bin includes a floor 161 and an end panel 167. As shown at FIG. 9B, once the loading bin 158 is inserted into the bag 157, the floor 161 is retracted, which may be enabled by a variety of mechanisms, such as a gear drive 168. Sliding the floor 161 from under the bottom of bin 158 leaves the contents of the bin inside the bag 157. As shown at C, the end panel 167 is raised, thereby allowing the bin 158 to be withdrawn from the bag along arrow 169. The medications 163 are thus deposited within the bag 157 with minimal risk of damaging any of the medications.

The bags of example embodiments may have resealable features which may be sealed and resealed upon removal of one or more articles. For certain medications or facilities, a tamper-evident seal may be more desirable. A heat-seal may be performed on a bag of example embodiments to provide a sealed package. As excess air contained within a bag after packaging may be undesirable, bags of example embodiments may be vented to allow air to escape, thereby minimizing the package size.

Figure 6:
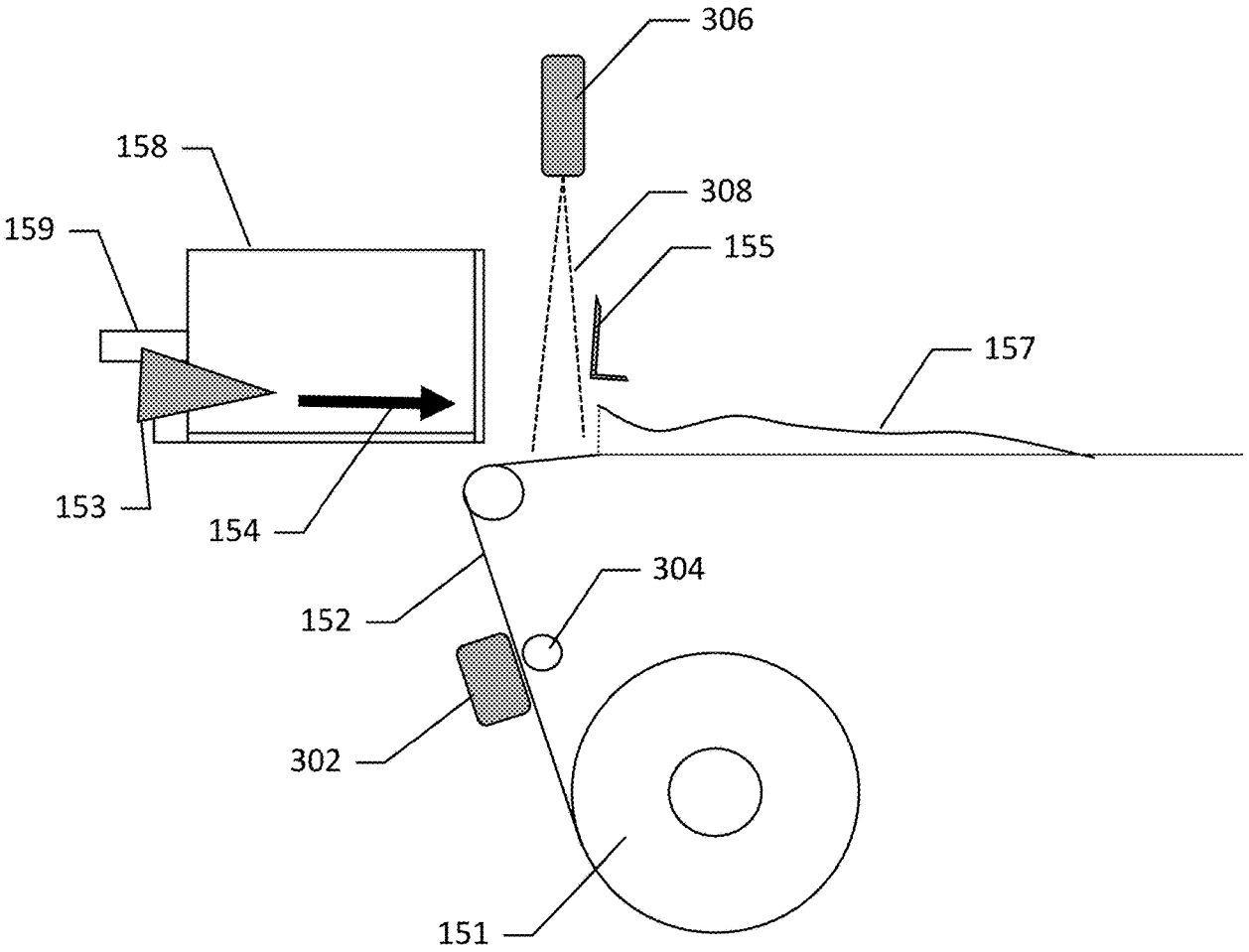
FIG. 6 illustrates a web of bags fed to an automated packaging system according to an example embodiment of the present disclosure.

FIG. 6 illustrates the packing station of example embodiments in which a web 152 of bags is fed from a roll or spool of bags 151 to the automated bagging region where a bag is filled. The web of bags may include a plurality of bags attached to one another along a first side of the bag, while the second side of the bag is able to be separated from an adjacent bag and opened. The packaging station may include a printing mechanism, such as the printhead 302 and platen roller 304 shown in FIG. 6. This printing mechanism may be a thermal printing mechanism, an ink-jet printing mechanism, laser printing mechanism, or the like, and may be configured to print identifying indicia to a particular bag. The indicia may include the contents of the bag that are to be loaded, a destination of the bag, a recipient of the bag, or other information to identify the bag and/or contents. Further, the indicia may be in human readable form, or may be in barcoded form, such as in one or two-dimensional barcodes.

The packaging station of example embodiments may optionally include an apparatus for reading of the indicia printed to a bag. FIG. 6 illustrates a reader 306 which may be in the form of a barcode scanner or image capture device configured to capture an image of the indicia of a bag and to interpret the indicia. Based upon the interpreted indicia, the controller, described further below, may confirm that the indicia matches the contents to be loaded into the bag or any other information associated with the order and/or contents, to ensure a bag includes indicia properly indicating information regarding the contents of the bag.

As shown in FIG. 6, the web of bags 152 is fed into the bagging or packaging station and a bag presented at the packaging station may be opened. The bag may be opened by pneumatic means, such as using a pneumatic stream of air from a nozzle 153, which may be a short burst of air or a current of air that opens the bag and maintains the bag in an open position. The bag 157 may optionally be opened by fingers 155 which may grasp a top side of the bag and pull open the bag, while holding it for receiving contents. The fingers 155 and the pneumatic air stream along arrow 154 may be used individually or in cooperation to open a bag and to hold open the bag during the packaging operation.

A web of bags 152 may include some bags which are more difficult to open than others due to potential inconsistencies in the manufacturing of the bags. As the packaging station described herein is automated, it is undesirable to have inconsistencies in the bags of the web of bags. However, in the event a bag of the web of bags cannot be opened, example embodiments described herein can dispose of the unopened bag without requiring manual intervention. A sensor of the packaging station, such as a sensor attached to finger 155, may provide an indication that a bag did not properly open after the bag-opening operation. In such an embodiment, the closure mechanism, described further below, may separate the unopened bag from the web of bags while the bag is disposed of either by a transport mechanism such as the pneumatic table described below or pushed out of the packaging station by a subsequent bag to be loaded. The print head 302 may be positioned in such a way that the next bag has not yet been printed when it is determined that a bag failed to open. In this way the controller may direct the print head 302 to print the same indicia to a subsequent bag such that the order of the loading bin 158 may be dispensed to a properly labeled bag.

Figure 7:
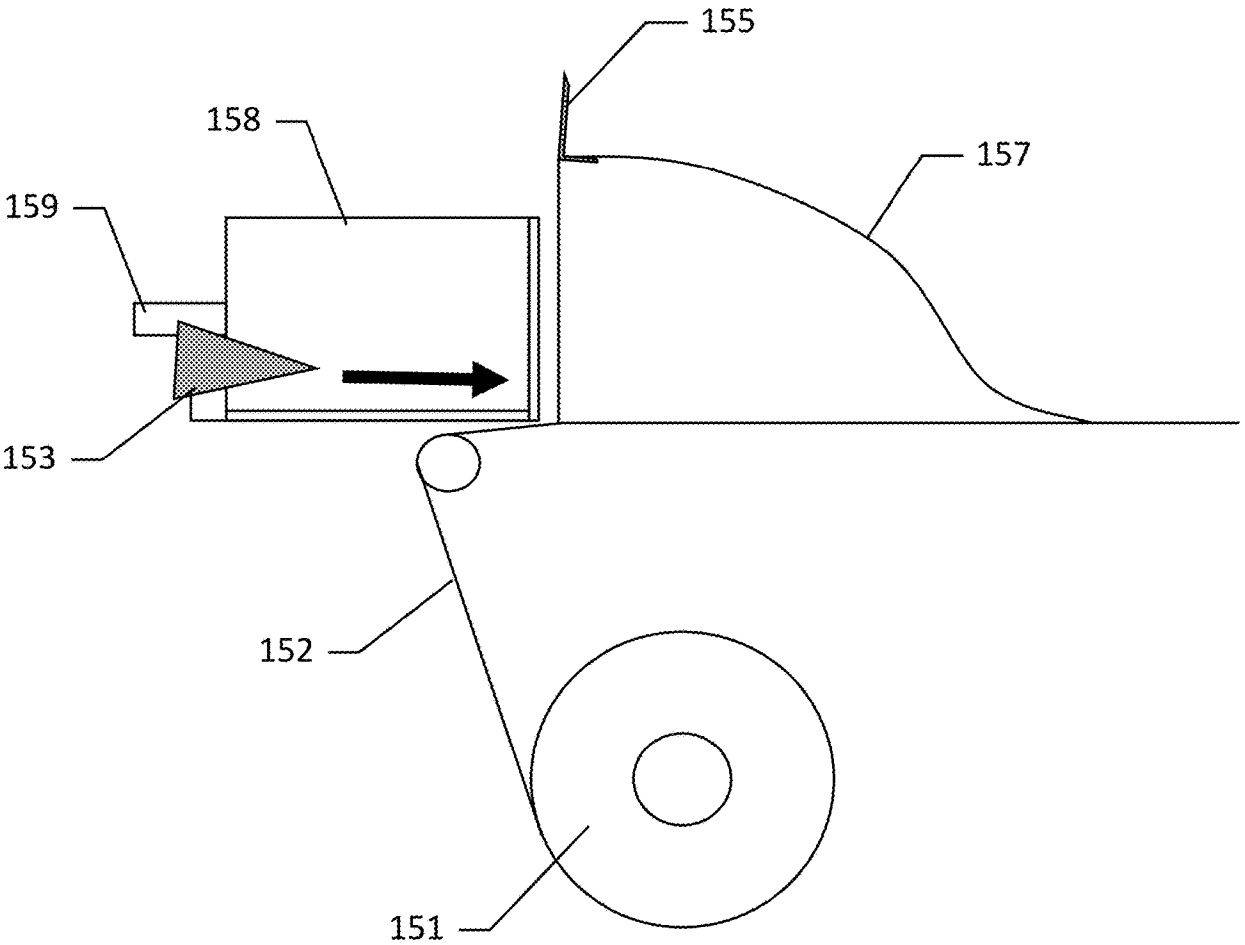
FIG. 7 illustrates a loading operation into an open bag of the web of bags according to an example embodiment of the present disclosure.
Figure 8:
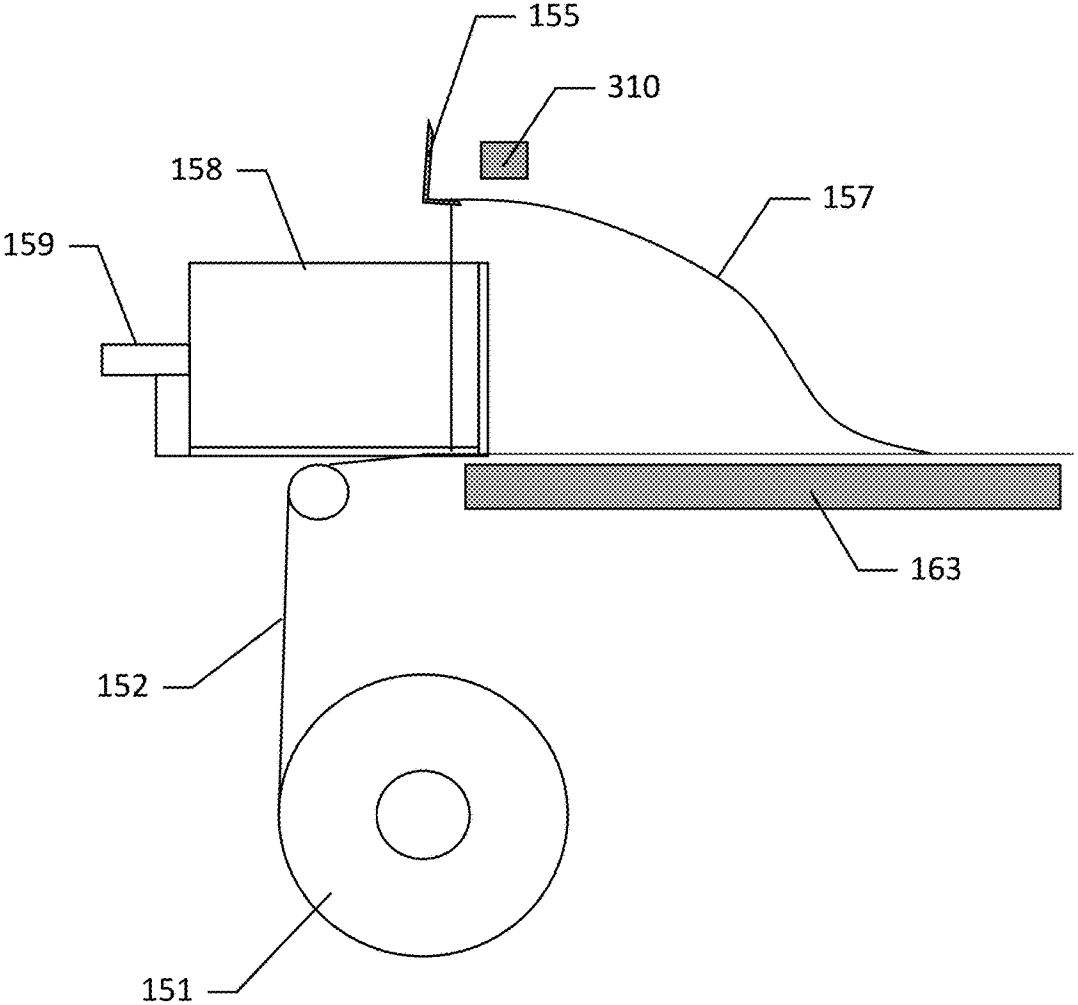
FIG. 8 depicts an automated packaging system including a pneumatic table according to an example embodiment of the present disclosure.

FIG. 7 illustrates the example embodiment of FIG. 6 after the bag 157 has been opened and is being held open by the fingers 155. FIG. 8 illustrates a bagging/packaging station where the bag 157 has been opened and is being held open by fingers not visible, but shown in FIG. 7. The loading bin 158 is shown at the initial stage of insertion into the bag 157. The example embodiment of FIG. 8 also includes a pneumatic table 163 onto which the bag 157 rests while being filled. The pneumatic table 163 is shown in FIG. 8 in a raised position, ready to support the bag 157 when filled. The pneumatic table includes a plurality of spaced orifices through which air is blown to support and make more buoyant a product supported thereon.

The pneumatic table 163 of example embodiments may be controlled by the below-described controller to be in a specific position relative to the packaging station and to provide the appropriate level of air flow through the table based on the products being packaged in an order. The pneumatic table 163 may have a raised position relative to the packaging station to support the products as they are inserted into the bag 157 by the loading bin 158. The pneumatic table may have a lowered position relative to the packaging station when products do not require such support, such as with light weight products or products that are less susceptible to damage. Further, the air flow through the pneumatic table may be varied based on the order that is filled. A heavier product that is inserted into a bag may cause a bag to conventionally be harder to move. However, using the pneumatic table 163, the filled bag may be easily moved, such as by motive force (e.g., air, mechanical pusher, etc.) or by gravity due to the lower friction provided by the air flowing through the pneumatic table. The amount of air flowing through the pneumatic table may include only an on/off valve to either provide air flow or to stop air flow through the pneumatic table, or the air flow may optionally be variable, as some products may be very light, and a high flow through the pneumatic table may cause the bagged product to rise off the table to an undesirable or uncontrollable height. Therefore, the functionality of the pneumatic table may be controlled on a per-order basis according to the contents of the order as established and controlled by the controller.

Figure 9:
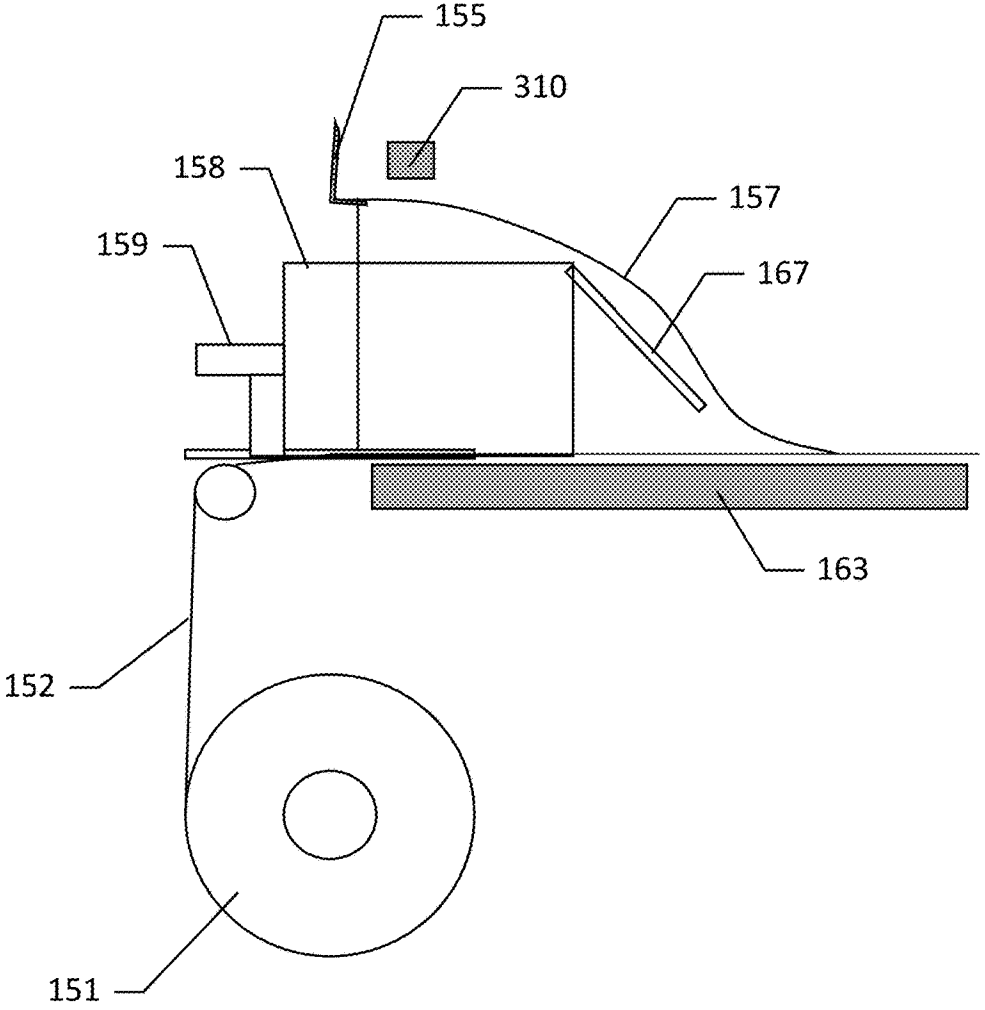
FIG. 9 illustrates an automated packaging system including a loading bin inserted into the open bag of an example embodiment of the present disclosure.
Figure 10:
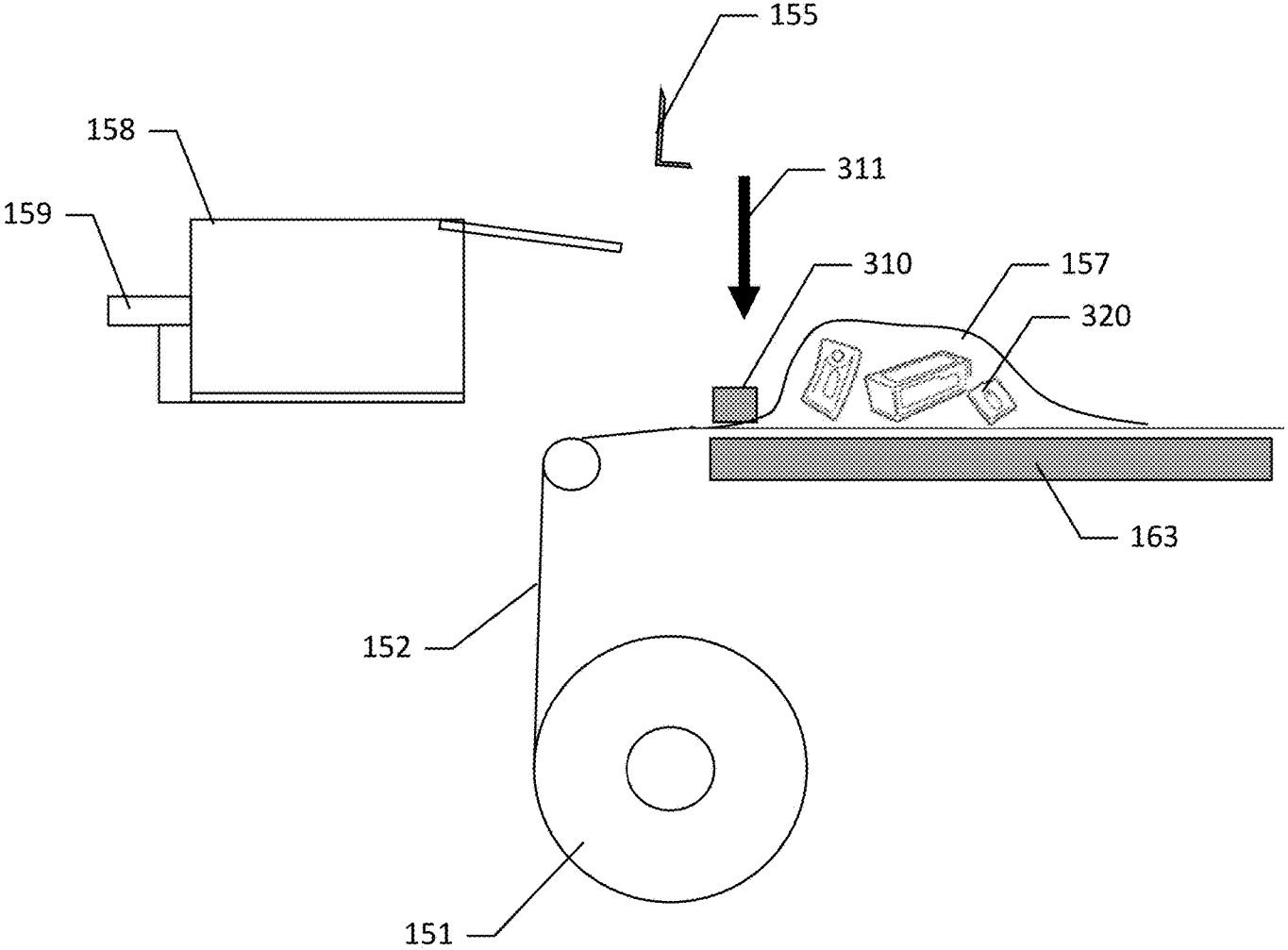
FIG. 10 illustrates an automated packaging system including a closure mechanism to close and seal a filled back according to an example embodiment of the present disclosure.

FIG. 9 illustrates the loading bin 158 inserted into the bag 157, as the end panel 167 is raised. As shown, the loading bin is substantially inserted into the bag 157 such that contents within the bin are surrounded by the bag, ready for transfer to the bag upon withdrawal of the loading bin 158. FIG. 10 illustrates the bag 157 after the loading bin 158 has been withdrawn. The contents 320 of the bag are then disposed within the bag, but may be pushed further into the bag by pneumatic means, such as nozzles 153, or through a push using a portion of the bin, such as a front panel 167 of the bin after it has been withdrawn and the front panel closed. The air assist to drive the contents 320 of the bin into the bag may be dynamically adjustable between on or off in dependence of the articles that comprise the contents 320 of the bag. The air assist may be configurable in terms of flow rate and pressure to adequately drive the contents 320 into the bag 157 to clear the closure region to enable sealing of the bag.

Once the contents of the bag are received by the bag, a closure mechanism 310 may be pressed down along arrow 311 on the opening of the bag to seal the opening. The closure mechanism may be of a variety of types of mechanisms based on the bag material and how the bag is intended to be sealed. For example, the closure means may be a heat seal, where the closure mechanism 310 is either a heating element or a platen to press the bag against a heating element. Optionally, a bag may be ultrasonically sealed, where the closure mechanism 310 presses the bag against an ultrasonic fusing means. The bag may include adhesive such that the closure mechanism 310 merely presses the ends of the bag together to close the bag against the adhesive. The closure mechanism may optionally include projections or orifices configured to receive projections, where a bag is closed using a crimping means.

Once the bag is closed and sealed, the bag may be separated from the web of bags. This may be performed by the closure mechanism 310, which may be configured to sever the filled bag from the web, such as by a blade or shearing action. Upon separating the sealed, filled bag from the web of bags, the filled bag may descend along the pneumatic table 163 to a transport mechanism. FIG. 11 illustrates the pneumatic table 163 moved to a lowered position allowing the bag 157 including the contents 320 to clear the packaging station and proceed to a next location, such as a transport mechanism. The transport mechanism may include a box, where the packaging station fills and seals bags before delivering them to a box for later delivery, or the transport mechanism may be a conveyor where filled and sealed bags are taken from the packaging station and delivered elsewhere for subsequent processing.

While the example embodiment above of the packaging/bagging station includes a separation operation by which one bag is separated from another after filling, the separation operation may not be necessary. The bags may be formed from a continuous web and may be filled without being separated, such that a bandolier of bags may be formed, which may be useful in embodiments in which multiple bags are destined for the same location or prescribed to the same patient. Optionally, medications may be dispensed for restocking medication cabinets, such that a bandolier of bags may be useful for restocking different medications within the same cabinet. Bags may be equipped with holes to minimize trapped air within the bag, and may include quick-access perforations to allow the bag to be easily opened. The printed portion or a portion thereof of the bag may be attached via perforation for easy removal. Patient information or information protected under the Health Information Protection Act (HIPAA) may be removable from the bag to comply with such protections. Bags may optionally be opaque or translucent rather than transparent to protect patient privacy or to mask the type of medication, such as narcotics, which may be a desirable target for theft.

Figure 12:
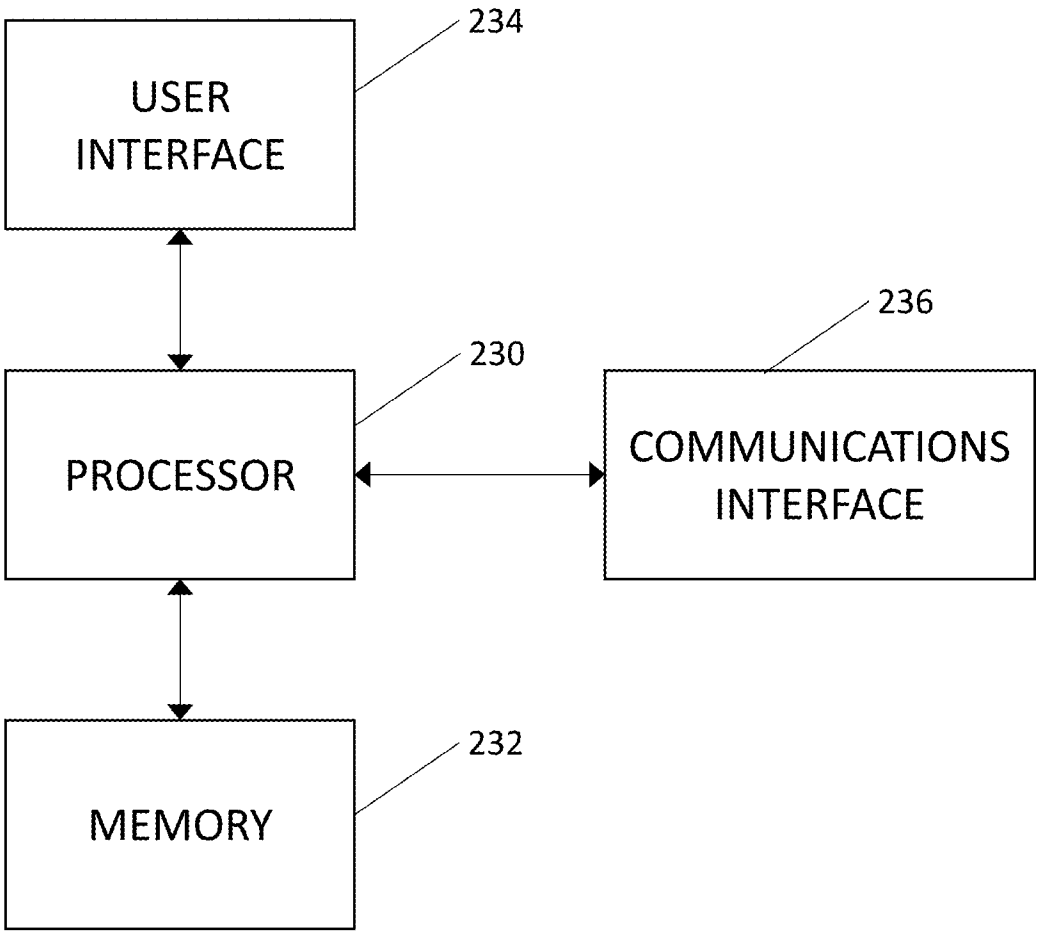
FIG. 12 depicts a block diagram of a controller for controlling various aspects of an automated packaging system according to an example embodiment of the present disclosure.

An automated dispensing and packaging system as described above may require a controller configured to control the functions of the automated dispensing and packaging. Optionally, the dispensing and packaging may be performed by separate systems that include separate controllers which may work in concert with one another. The controller or controllers of example embodiments may be configured in a variety of manners, an example of which is illustrated in FIG. 12. The controller of example embodiments may include processing circuitry. The processing circuitry may be configured to perform actions in accordance with one or more example embodiments disclosed herein. In this regard, the processing circuitry may be configured to perform and/or control performance of one or more functionalities of the handling, storing, or distributing of articles such as medications and/or supplies in accordance with various example embodiments. The processing circuitry may be configured to perform data processing, application execution, and/or other processing and management services according to one or more example embodiments. In some embodiments, computing device or a portion(s) or component(s) thereof, such as the processing circuitry, may be embodied as or comprise a circuit chip. The circuit chip may constitute means for performing one or more operations for providing the functionalities described herein.

A schematic illustration of an apparatus which may be implemented as a controller of an automated dispensing system is illustrated in FIG. 12. As shown, in some example embodiments, the processing circuitry may include a processor 230 and, in some embodiments, may further include memory 232. The processing circuitry may be in communication with, include or otherwise control a user interface 234 and/or a communication interface 236. As such, the processing circuitry may be embodied as a circuit chip (e.g., an integrated circuit chip) configured (e.g., with hardware, software, or a combination of hardware and software) to perform operations described herein.

The processor 230 may be embodied in a number of different ways. For example, the processor may be embodied as various processing means such as one or more of a microprocessor or other processing element, a coprocessor, a controller, or various other computing or processing devices including integrated circuits such as, for example, an ASIC (application specific integrated circuit), an FPGA (field programmable gate array), or the like. Although illustrated as a single processor, it will be appreciated that the processor may comprise a plurality of processors. The plurality of processors may be in operative communication with each other and may be collectively configured to perform one or more functionalities of a system for handling, storing, transporting, or distributing medication as described herein. The plurality of processors may be embodied on a single computing device or distributed across a plurality of computing devices. In some example embodiments, the processor may be configured to execute instructions stored in the memory or otherwise accessible to the processor. As such, whether configured by hardware or by a combination of hardware and software, the processor may represent an entity (e.g., physically embodied in circuitry—in the form of processing circuitry) capable of performing operations according to embodiments of the present invention while configured accordingly. Thus, for example, when the processor is embodied as an ASIC, FPGA, or the like, the processor may be specifically configured hardware for conducting the operations described herein. Alternatively, as another example, when the processor is embodied as an executor of software instructions, the instructions may specifically configure the processor to perform one or more operations described herein.

In some example embodiments, the memory 232 may include one or more non-transitory memory devices such as, for example, volatile and/or non-volatile memory that may be either fixed or removable. In this regard, the memory 232 may comprise a non-transitory computer-readable storage medium. It will be appreciated that while the memory 232 is illustrated as a single memory, the memory may comprise a plurality of memories. The plurality of memories may be embodied on a single computing device or may be distributed across a plurality of computing. The memory may be configured to store information, data, applications, instructions and/or the like for enabling embodiments of the present invention to carry out various functions in accordance with one or more example embodiments. For example, the memory may be configured to buffer input data for processing by the processor. Additionally or alternatively, the memory may be configured to store instructions for execution by the processor. As yet another alternative, the memory may include one or more databases that may store a variety of files, contents, or data sets. Among the contents of the memory, applications may be stored for execution by the processor to carry out the functionality associated with each respective application.

A user interface 234 of example embodiments, such as the user interface of a user module of an automated dispensing system, may be in communication with the processing circuitry to receive an indication of a user input at the user interface and/or to provide an audible, visual, mechanical, or other output to the user. As such, the user interface may include, for example, a user input interface 234 such as a keyboard, a mouse, a joystick, a display, a touch screen display, a microphone, a speaker, and/or other input/output mechanisms. As such, the user interface may 234, in some example embodiments, provide means for user control of embodiments of the present invention. In some example embodiments in which the invention is embodied as a server, cloud computing system, or the like, aspects of user interface may be limited or the user interface may not be present. In some example embodiments, one or more aspects of the user interface may be implemented on a user terminal. Accordingly, regardless of implementation, the user interface may provide input and output means to facilitate handling, storing, transporting, or delivery of medication in accordance with one or more example embodiments.

The communication interface 236 may include one or more interface mechanisms for enabling communication with other devices and/or networks. In some cases, the communication interface may be any means such as a device or circuitry embodied in either hardware, or a combination of hardware and software that is configured to receive and/or transmit data from/to a network and/or any other device or module in communication with the processing circuitry. By way of example, the communication interface 236 may be configured to enable embodiments of the present invention to communicate with application server(s) and/or networks and/or information databases. Accordingly, the communication interface may, for example, include supporting hardware and/or software for enabling communications via cable, digital subscriber line (DSL), universal serial bus (USB), Ethernet, or other methods.

The controller of example embodiments may be configured to control various aspects of the dispensing and packaging operations. With respect to packaging and bagging, various operations may be controlled according to the order being placed into the bag, and according to certain characteristics of the one or more articles of the order. As described above, an order may include a plurality of articles. These articles may be retrieved by the automated dispensing system, and presented to the packaging station in the loading bin 157. In preparation for the order, the controller may cause the print head 302 to print indicia to a bag that is to receive the order. The controller may indicate what information to print. The controller may be configured to operate the packaging station according to a "recipe" for the specific order, where different operations are performed based on the specific needs of an order.

According to some embodiments, an order may be received by the controller of the automated packager, and the contents identified to establish an appropriate packaging recipe. The controller may determine each individual article of the order, and identify the packaging recipe for the combination of articles within the order. For example, an order including only small, lightweight objects, may include a position indication for the pneumatic table to be in a down position, and the air flow through the pneumatic table to be low. Further, such an order may require an air-assisted insertion of the product into the bag after the loading bin 158 has dropped the product into the bag to ensure the products are sufficiently clear of the closure so as not to interfere with the closure mechanism.

FIG. 12 includes an example embodiment of a user interface screen which may define the operational parameters for a variety of articles to be packaged. Examples includes small oral solids, large oral solids, small/medium vials, syringes, mixed medications with or without a vial, boxes, etc. For each type of article, various operating parameters of the packaging station may be defined. For example, in the case of a small oral solid, the air table is positioned at a low position, the flow through the air table is low, and an air pulse is used to ensure the articles are pushed into the bag after the loading bin has been withdrawn. Conversely, for a syringe which is a heavier article, the air table is enabled and positioned in a raised position, while air flow through the pneumatic table is higher and an air pulse is not used to push the product into the bag.

Figure 13:
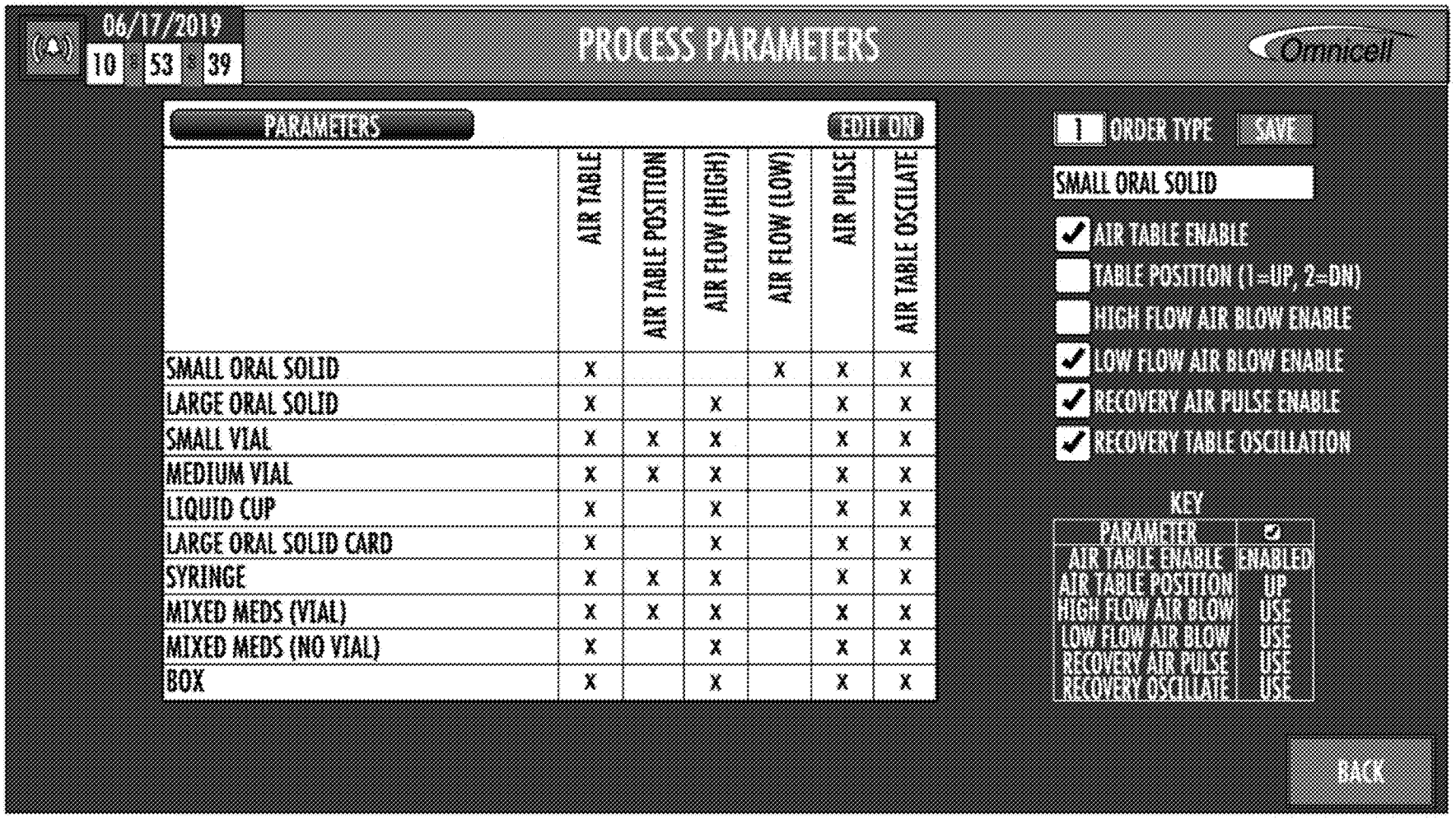
FIG. 13 illustrates operating parameters of an automated packaging system based on articles to be packaged according to an example embodiment of the present disclosure.

While FIG. 13 indicates the recipe for a variety of individual articles, recipes may exist or may be determined for combinations of articles. For example, an order including a small oral solid and a syringe may still use a pulse of air to insert the products into the bag as the small oral solid may require this, while the syringe is not adversely affected. Further, if a bag is to contain a plurality of articles that raise the cumulative weight above a predefined threshold, the pneumatic table may be used in a raised position. Embodiments described herein identify the articles in an order and identify operating parameters for the packaging station accordingly.

Figure 14:
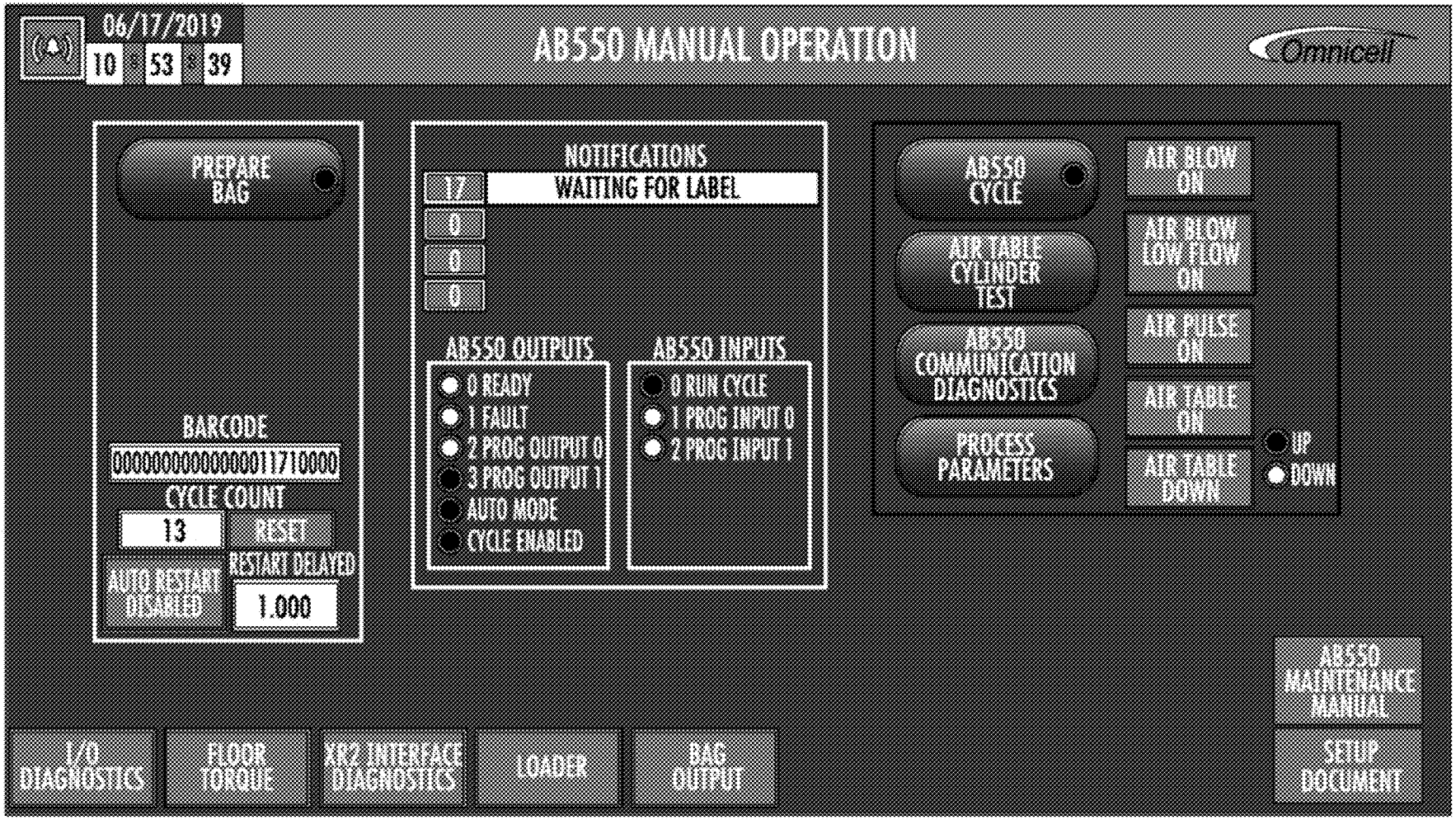
FIG. 14 illustrates a graphical user interface of an automated packaging system according to an example embodiment of the present disclosure.

FIG. 14 illustrates an example embodiment of a user interface for a packaging station as described herein. As shown, the various functions are depicted on the user interface to provide an operator with an understanding of the operational state of the packaging station.

Figure 15:
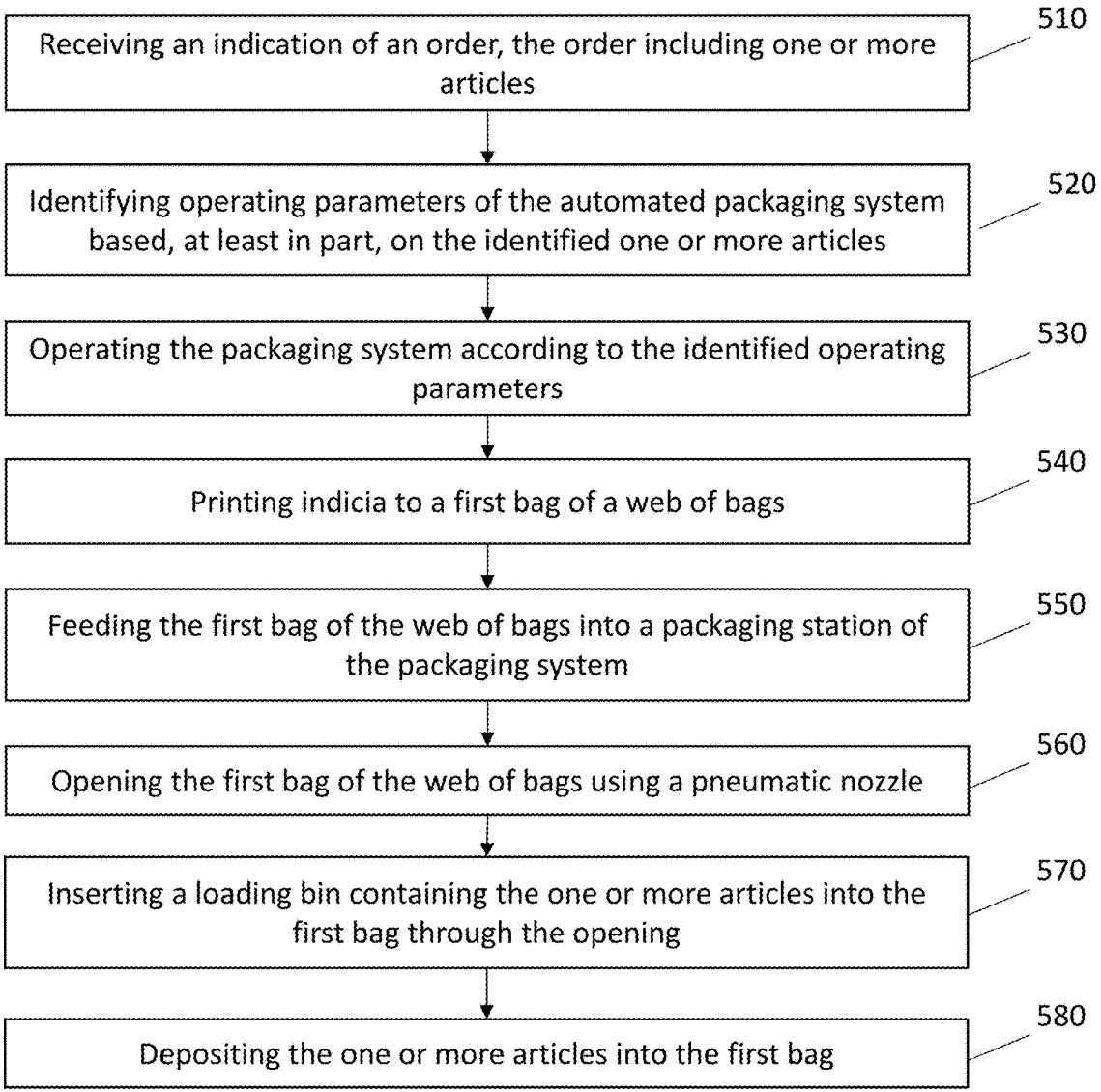
FIG. 15 is a flowchart of a method of operation of an automated packaging system of example embodiments of the present disclosure.

FIG. 15 is a flowchart of a method and program product according to an example embodiment of the present invention. It will be understood that each block of the flowchart and combinations of blocks in the flowchart may be implemented by various means, such as hardware, firmware, processor, circuitry, and/or other devices associated with execution of software including one or more computer program instructions. These computer program instructions may also be stored in a non-transitory computer-readable memory that may direct a computer or other programmable apparatus to function in a particular manner, such that the instructions stored in the computer-readable memory produce an article of manufacture which implements the functions specified in the flowchart blocks. The computer program instructions may also be loaded onto a computer or other programmable apparatus to cause a series of operations to be performed on the computer or other programmable apparatus to produce a computer-implemented process such that the instructions which execute on the computer or other programmable apparatus implement the functions specified in the flowchart block(s).

Accordingly, blocks of the flowchart support combinations of means for performing the specified functions and combinations of operations for performing the specified functions. It will also be understood that one or more blocks of the flowchart, and combinations of blocks in the flowchart, can be implemented by special purpose hardware-based computer systems which perform the specified functions, or combinations of special purpose hardware and computer instructions.

In this regard, a method according to one embodiment of the disclosure, as shown in FIG. 15, may include receiving an indication of an order, where the order includes one or more articles to be packaged, as shown at 510. Operating parameters for the packaging system may be identified at 520 based, at least in part, on the identified one or more articles. The packaging system may be operated according to the operating parameters as indicated at 530. Operating the packaging system according to the identified operating parameters may include printing indicia to a first bag of a web of bags as shown at 540. The first bag of the web of bags may be fed into a packaging station of the packaging system as shown at 550. The first bag may be opened as shown at 560 using a pneumatic nozzle, for example. A loading bin may be inserted into the open bag as shown at 570, where the loading bin includes the one or more articles. The one or more articles may be deposited by the bin into the bag at 580.

In some embodiments, certain ones of the operations may be modified or further amplified as described below. Moreover, in some embodiments additional operations may also be included. It should be appreciated that each of the modifications, optional additions, or amplifications below may be included with the operations above either alone or in combination with any others among the features described herein.

In an example embodiment, an apparatus for performing the method of FIG. 14 may include a processor configured to perform some or all of the operations (510-580) described above. The processor may, for example, be configured to perform the operations (510-580) by performing hardware implemented logical functions executing stored instructions, or executing algorithms for performing each of the operations. Alternatively, the apparatus may include means for performing each of the operations described above.

An example of an apparatus according to an example embodiment may include at least one processor and at least one memory including computer program code. The at least one memory and the computer program code may be configured to, with the at least one processor, cause the apparatus to perform the operations 510-580.

An example of a computer program product according to an example embodiment may include at least one computer-readable storage medium having computer-executable program code portions stored therein. The computer-executable program code portions may include program code instructions for performing operations 510-580.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

That which is claimed:

1. A method for operating an automated packaging system comprising:

receiving an indication of an order, wherein the order comprises one or more articles;

identifying the one or more articles of the order;

identifying operating parameters of the automated packaging system based, at least in part, on the identified one or more articles of the order; and operating the packaging system according to the identified operating parameters, wherein operating the packaging system according to the identified operating parameters comprises:

feeding a first bag of a web of bags to a packaging station of the packaging system, wherein the packaging station comprises a horizontal surface on which the first bag is received;

opening the first bag of the web of bags using a pneumatic nozzle to define an opening of the first bag;

inserting a loading bin containing the one or more articles into the first bag through the opening;

providing a pulse of air to push the one or more articles in a horizontal direction into the first bag from the loading bin based on an operating parameter of the identified operating parameters, wherein the operating parameter comprises an air pressure or air volume determined to be sufficient to push the one or more articles into the first bag, and depositing the one or more articles into the first bag.

2. The method according to claim 1, wherein operating the packaging system further comprises:

printing indicia to the first bag of the web of bags, wherein the indicia identifies the one or more articles.

3. The method according to claim 1, further comprising:

closing the first bag disposed at the packaging station after the one or more articles have been deposited into the first bag.

4. The method according to claim 3, further comprising:

sealing the first bag disposed at the packaging station with a closure apparatus after the closing the first bag.

5. The method of claim 1, further comprising:

holding the first bag in an open position with one or more fingers inserted into the opening of the first bag after opening the first bag of the web of bags.

6. The method of claim 1, further comprising:

supplying a pneumatic table defining the horizontal surface of the packaging system supporting the first bag with a predetermined level of positive air flow based on the identified operating parameters to reduce friction between the first bag and the pneumatic table.

7. The method of claim 6, wherein the predetermined level of air flow based on the identified operating parameters comprises a level of air flow through the pneumatic table based on a weight of the one or more articles of the order.

8. An automated packaging system comprising:

a controller configured to receive an indication of an order to be packaged, wherein the order comprises one or more articles identified by the controller;

a packaging station, wherein the controller is configured to identify operating parameters of the automated packaging system based, at least in part, on the one or more articles identified by the controller and to control operation of the packaging station according to the operating parameters;

a web of bags, wherein the web of bags includes at least a first bag fed to the packaging station, wherein the packaging station comprises a horizontal surface on which the first bag is received;

an opening mechanism comprising a pneumatic nozzle to open an opening of the first bag disposed at the packaging station;

a loading bin containing the one or more articles configured to be inserted at least partially into the opening of the first bag disposed at the packaging station; and a loading mechanism employing the pneumatic nozzle to direct a pulse of air to push the one or more articles in a horizontal direction from the loading bin into the first bag disposed at the packaging station, wherein the pulse of air is at least partially defined by a parameter determined based, at least in part, on one or more properties of the one or more articles, wherein the parameter comprises at least one of an air pressure or air volume determined to be sufficient to push the one or more articles into the first bag.

9. The automated packaging system of claim 8, further comprising:

printing station, wherein the printing station prints an identification of the one or more articles of the order to the first bag.

10. The automated packaging system of claim 9, wherein the printing station further comprises:

a printhead configured to print identifying indicia to the web of bags as they are fed into the packaging station; and an indicia reader configured to read the identifying indicia printed to the web of bags.

11. The automated packaging system of claim 9, further comprising:

a closure apparatus to seal the first bag disposed at the packaging station after the one or more articles are pushed into the first bag.

12. The automated packaging system of claim 8, wherein the one or more properties of the one or more articles comprises at least one of a size of the one or more articles or a weight of the one or more articles.

13. The automated packaging system of claim 8, wherein the opening mechanism further comprises one or more fingers inserted into the opening of the first bag to hold the first bag in an open position.

14. The automated packaging system of claim 8, further comprising: a pneumatic table defining the horizontal surface configurable to support the first bag disposed at the packaging station.

15. The automated packaging system of claim 14, wherein the pneumatic table is supplied with a predetermined level of positive air flow based on the operating parameters identified based on the one or more properties of the one or more articles to reduce friction between the pneumatic table and the first bag.

16. The automated packaging system of claim 15, wherein the one or more properties of the one or more articles comprises at least one of a size of the one or more articles or a weight of the one or more articles.

* * * * *